US008470157B2

(12) United States Patent
Friesen et al.

(10) Patent No.: US 8,470,157 B2
(45) Date of Patent: Jun. 25, 2013

(54) METHOD AND APPARATUS FOR AMMONIA ($NH_3$) GENERATION

(75) Inventors: Cody A. Friesen, Fort McDowell, AZ (US); Joel R. Hayes, Chandler, AZ (US); Robert August Zeller, Tempe, AZ (US)

(73) Assignee: Arizona Board or Regents for and on Behalf of Arizona State University, Tempe, AZ (US)

( * ) Notice: Subject to any disclaimer, the term of this patent is extended or adjusted under 35 U.S.C. 154(b) by 0 days.

(21) Appl. No.: 13/612,312

(22) Filed: Sep. 12, 2012

(65) Prior Publication Data

US 2013/0001098 A1 Jan. 3, 2013

Related U.S. Application Data

(62) Division of application No. 13/290,830, filed on Nov. 7, 2011, now Pat. No. 8,282,809, which is a division of application No. 11/928,869, filed on Oct. 30, 2007, now Pat. No. 8,075,757.

(60) Provisional application No. 60/871,244, filed on Dec. 21, 2006.

(51) Int. Cl.
*C25B 1/00* (2006.01)

(52) U.S. Cl.
USPC ..... 205/552; 205/360

(58) Field of Classification Search
USPC ..... 205/360, 552
See application file for complete search history.

(56) References Cited

U.S. PATENT DOCUMENTS

| | | | | |
|---|---|---|---|---|
| 4,547,273 | A | 10/1985 | Ayers | |
| 5,670,036 | A | 9/1997 | Campbell | |
| 6,037,459 | A | 3/2000 | Cummins | |
| 6,117,407 | A | 9/2000 | Cummins | |
| 6,462,213 | B1 | 10/2002 | Cummins et al. | |
| 6,712,950 | B2 | 3/2004 | Denvir | |
| 6,881,308 | B2 | 4/2005 | Denvir | |
| 8,075,757 | B2 * | 12/2011 | Friesen et al. | 205/360 |
| 2005/0087449 | A1 | 4/2005 | Denvir | |
| 2006/0049063 | A1 | 3/2006 | Denvir et al. | |

OTHER PUBLICATIONS

Cook et al., "Ambient Temperature Gas Phase Electrochemical Nitrogen Reduction to Ammonia at Ruthenium/Solid Polymer Electrolyte Interface", Catalysis Letters (no month, 1988), vol. 1, pp. 345-350.*

Ito et al., "Novel Electrochemical Reactions Related to Electrodeposition and Electrochemical Synthesis", J. of Mining and Metallurgy (no month, 2003), vol. 39, Nos. 1-2 B, pp. 233-249.*

(Continued)

*Primary Examiner* — Edna Wong
(74) *Attorney, Agent, or Firm* — Pillsbury Winthrop Shaw Pittman LLP

(57) ABSTRACT

Various apparatuses and methods for producing ammonia are provided. One embodiment has uses in a plurality of environments and an electrode configured to be exposed to the plurality of environments. The electrode is configured to receive hydrogen while being exposed to one of the environments, reduce nitrogen while being exposed to another environment, and allow the hydrogen and nitrogen to react with each other to form ammonia. Other embodiments provide for simultaneous hydrogen oxidation and nitrogen reduction at the same electrode, which in turn react for formation of ammonia.

7 Claims, 15 Drawing Sheets

OTHER PUBLICATIONS

Nishikiori et al., "Effect of Absorbed Hydrogen on Surface Nitriding by Molten Salt Electrochemical Process", Electrochemical and Solid-State Letters (no month, 2000), vol. 3, No. 12, pp. 552-554.*
Chen et al., "Electrocatalysts Under Conditions of High Mass Transport: Investigation of Hydrogen Oxidation on Single Submicron Pt Particles Supported on Carbon", J. Phys. Chem. B (no month, 2004), vol. 108, pp. 13984-13994.*
Murakami et al., "Electrolytic Synthesis of Ammonia in Molten Salts under Atmospheric Pressure", J. Am. Chem. Soc., vol. 125, pp. 334-335 (2003).
Tsuneto et al., "Lithium-mediated electrochemical reduction of high pressure N2 to NH3", J. of Electroanalytical Chemistry, vol. 367, pp. 183-188 (1994).
Kordali et al., "Electrochemical synthesis of ammonia at atmospheric pressure and low temperature in solid polymer electrolyte cell", Chem. Comm., pp. 1673-1674 (2000).
Marnellos et al., "Synthesis of Ammonia at Atmospheric Pressure with the Use of Solid State Proton Conductors", J. of Catalysis, vol. 193, pp. 80-87 (2002).
Marnellos et al., "Ammonia Synthesis at Atmospheric Pressure", Science, vol. 282, pp. 98-100 (1998).
Hellman et al., "Predicting Catalysis: Understanding Ammonia Synthesis from First-Principles Calculations", J. Phys. Chem. B, vol. 110, pp. 7719-7735 (2006).
Mohamed S. El-Deab, "Electrochemical reduction of nitrate to ammonia at modified gold electrodes", Electrochimica Acta, vol. 9, 00. 1639-1645 (2004).
Office Action issued in corresponding Chinese Patent Application No. 200780047154.4 dated Jun. 8, 2010 and English translation thereof.
Office Action issued in corresponding Chinese Patent Application No. 200780047154.4 dated Nov. 30, 2010 and English translation thereof.
Intl Search Report/Written Opinion of PCT/US2007/085907, May 8, 2008 (13 pages).
Ito et al., "Electrochemistry of nitrogen and nitrides in molten salts", J. of Nuclear Materials, vol. 344, pp. 128-135 (2005).

* cited by examiner

METHOD AND APPARATUS FOR AMMONIA ($NH_3$) GENERATION

CROSS-REFERENCE TO RELATED APPLICATIONS

This application is a divisional application under 35 U.S.C. §121 of U.S. patent application Ser. No. 13/290,830 filed Nov. 7, 2011 (now U.S. Pat. No. 8,282,809), which is a divisional application of U.S. patent application Ser. No. 11/928,869 filed Oct. 30, 2007 (now U.S. Pat. No. 8,075,757), which claims the benefit of priority from U.S. Provisional Patent Application Ser. No. 60/871,244, filed Dec. 21, 2006, the entire content of each is incorporated herein by reference.

BACKGROUND OF THE INVENTION

1. Field of the Invention

The present invention generally relates to a method and apparatus for generating ammonia ($NH_3$).

2. Description of Related Art

Currently, annual ammonia production exceeds 110 million metric tons, which is more than any other inorganic chemical. Approximately 80% of ammonia produced is used in agriculture. The modern, large scale manufacture of ammonia is accomplished through the Haber-Bosch process. Originally patented in 1910 (U.S. Pat. No. 971,501) by Fritz Haber and Robert Le Rossignol, the process was later commercialized by Carl Bosch and was first used for wide scale ammonia production by Germany in World War I. The Haber-Bosch process has remained fundamentally the same since that time.

The Haber-Bosch process reacts molecular hydrogen and nitrogen over an iron catalyst at high pressures (around 150 atm.) and extremely high temperatures (around 450° C.) to produce ammonia ($NH_3$) with a 10-20% yield. The temperatures and pressures involved in this process require large energy expenditures. In addition, the molecular hydrogen feed-stock requires an extensive pre-processing step that utilizes fossil fuel, such as natural gas (methane) or liquefied petroleum gas (propane and butane) or petroleum naphtha, to produce the hydrogen. These fossil fuels are transformed into hydrogen via steam reformation and the water gas shift reaction, both of which occur at high temperatures and pressures.

The Haber-Bosch process also requires a delicate balance of temperature and pressure to optimize ammonia output. High temperatures increase the reaction rate, but also drive the equilibrium toward molecular hydrogen and nitrogen, and away from ammonia. Therefore, high pressures are applied to drive the equilibrium back towards ammonia in an attempt to maximize ammonia production. Thus, much of the energy expended in the manufacturing process is wasted on these competing processing variables.

Attempts have been made to use electrochemical synthesis to produce ammonia under standard conditions. The half-cell reaction $$N_2+6e^-\rightarrow 2N^{3-} \quad (1)$$

occurs at electrode potentials well below the potential that the half-cell reaction $$H^++1e^-\rightarrow \tfrac{1}{2}H_2 \quad (2)$$

occurs. Therefore, in reducing $N_2$ in an attempt to produce $NH_3$ in environments where hydrogen is present to act as a constituent in the ammonia, an overwhelming majority of the current goes towards the reduction of hydrogen rather than to the reduction of nitrogen. A number of attempts have been made to overcome this fundamental issue, such as using catalysts that are selective for the reduction of $N_2$, and utilizing organic proton sources that have poor electrochemical activity (e.g., ethanol), and performing the reaction in highly basic aqueous solutions to limit the availability of hydrogen, but have had very limited success.

Therefore, an improved process that produces higher yields and requires less energy than the Haber-Bosch process is desired.

BRIEF SUMMARY OF THE INVENTION

It is an aspect of the present invention to provide a method for producing ammonia from hydrogen and nitrogen.

In one embodiment, a method for making ammonia ($NH_3$) using multiple potentials is provided. The method includes exposing a hydrogen receptive electrode having absorbed hydrogen to a nitrogen-containing electrolyte that includes nitrogen. The hydrogen may be atomic (H), but may also be absorbed in other forms (molecular or ionic). A first potential is applied to the hydrogen receptive electrode while exposed to the nitrogen-containing electrolyte to reduce the nitrogen to nitride ions ($N^{3-}$) at the electrode. The method also includes applying a second potential more anodic than the first potential to the hydrogen receptive electrode to oxidize the hydrogen absorbed in the electrode and create cationic hydrogen ($H^+$) at the electrode, so that the cationic hydrogen and the nitride ions at the electrode combine to form ammonia.

In another embodiment, a method for making ammonia ($NH_3$) enabling simultaneous reduction of nitrogen and oxidation of hydrogen is provided. The method includes exposing an electrode having absorbed hydrogen to a nitrogen-containing non-aqueous electrolyte having a proton activity. The hydrogen may be atomic (H), but may also be absorbed in other forms (molecular or ionic). Hydrogen is simultaneously oxidized at the electrode to form hydrogen protons ($H^+$) while the nitrogen is reduced at the electrode to form nitride ions ($N^{3-}$) at at least one potential anodic of the oxidation potential of hydrogen and cathodic of the reduction potential of nitrogen. Both the concentration of hydrogen in the electrode and the proton activity of the electrolyte are at levels to enable simultaneous oxidation of the absorbed hydrogen and reduction of nitrogen. The hydrogen protons and the nitride ions at the electrode combine to form ammonia.

Another aspect of the invention provides for generating ammonia with simultaneous reduction of nitrogen and oxidation of hydrogen. In this aspect, the method comprises exposing an electrode comprising absorbed hydrogen to a nitrogen-containing non-aqueous electrolyte. Simultaneously the absorbed hydrogen is oxidized at the electrode to form hydrogen protons ($H^+$) and the nitrogen is reduced at the electrode to form nitride ions ($N^{3-}$), with the electrode simultaneously functioning both as an anode for oxidizing the hydrogen and as a cathode for reducing the nitrogen. The $H^+$ and $N^{3-}$ are reacted to form $NH_3$.

Yet another aspect of the invention provides for generating ammonia with simultaneous reduction of nitrogen and oxidation of hydrogen. In this aspect, the method comprises exposing an electrode comprising absorbed hydrogen to a nitrogen containing non-aqueous electrolyte having a proton activity. Simultaneously, the absorbed hydrogen is oxidized at the electrode to form hydrogen protons ($H^+$) and the nitrogen is reduced at the electrode to form nitride ions ($N^{3-}$). The proton activity of the electrolyte is below a threshold to enable the electrode to simultaneously function both as an anode for oxidizing the hydrogen and as a cathode for reducing the nitrogen. The $H^+$ and the $N^{3-}$ react to form $NH_3$.

Still another aspect of the invention provides for generating ammonia with simultaneous reduction of nitrogen and oxidation of hydrogen. In this aspect, the method comprises exposing an electrode comprising absorbed hydrogen to a nitrogen containing non-aqueous electrolyte. Simultaneously, the absorbed hydrogen is oxidized at the electrode to form hydrogen protons ($H^+$) and the nitrogen is reduced at the electrode to form nitride ions ($N^{3-}$). A concentration of hydrogen in the electrode is above a threshold to enable the electrode to simultaneously function both as an anode for oxidizing the hydrogen and as a cathode for reducing the nitrogen. The $H^+$ and the $N^{3-}$ react to form $NH_3$.

In another aspect of the invention where ammonia is generated with simultaneous reduction of nitrogen and oxidation of hydrogen, the method comprises: exposing an electrode comprising absorbed hydrogen to a nitrogen containing non-aqueous electrolyte; and simultaneously oxidizing the absorbed hydrogen at the electrode to form hydrogen protons ($H^+$), reducing the nitrogen at the electrode to form nitride ions ($N^{3-}$), and reacting the $H^+$ and the $N^{3-}$ to form $NH_3$.

Another aspect of the invention provides a method for making ammonia where the hydrogen is absorbed via one surface of a working electrode to drive hydrogen oxidation and nitrogen reduction at an opposite surface of the electrode. In this aspect, the method comprises exposing a first surface of a hydrogen receptive working electrode to a hydrogen containing electrolyte and a second surface of the electrode to a non-aqueous nitrogen-containing electrolyte, the electrolytes being separated from one another by the working electrode. A current is applied between the working electrode and a counter electrode exposed to the hydrogen containing electrolyte so as to cause absorption of molecular hydrogen into the working electrode via the first surface. The molecular hydrogen is absorbed into the working electrode at a concentration such that the working electrode at the second surface thereof simultaneously oxidizes the absorbed molecular hydrogen to form hydrogen protons ($H^+$) and reduces the nitrogen to form nitride ions ($N^{3-}$). The $H^+$ and $N^{3-}$ react to form $NH_3$.

It is another aspect of the present invention to provide an apparatus that is configured to produce ammonia from hydrogen and nitrogen.

In one embodiment, an apparatus for generating ammonia is provided. The apparatus includes a first chamber that is constructed and arranged to hold a hydrogen-containing electrolyte, a second chamber that is constructed and arranged to hold a nitrogen-containing electrolyte, a third chamber that is constructed and arranged to collect ammonia ($NH_3$), and an electrode constructed and arranged to be exposed to the first chamber, the second, chamber, and the third chamber, in that order, such that the electrode absorbs atomic or ionic hydrogen in the first chamber, receives nitride ions ($N^{3-}$) at a surface of the electrode in the second chamber, and releases ammonia in the third chamber.

In another embodiment, another apparatus for generating ammonia is provided. The apparatus includes a first chamber that is constructed and arranged to hold a hydrogen-containing electrolyte, a second chamber that is constructed and arranged to hold a nitrogen-containing electrolyte, a separator and an electrode system such that a working electrode absorbs hydrogen in the first chamber, both oxidizes hydrogen and reduces nitrogen at the working electrode surface in the second chamber, and releases ammonia to the outside of the apparatus.

In still another embodiment, another apparatus for generating ammonia is provided. The apparatus includes a first chamber that is constructed and arranged to hold a nitrogen-containing electrolyte, a second chamber that is constructed and arranged to hold a hydrogen-containing electrolyte, and a working electrode that absorbs hydrogen and then both oxidizes hydrogen and reduces nitrogen at a surface. The first chamber includes a reference electrode and the second chamber includes a reference electrode and a counter electrode to provide the electrochemical environment in which the ammonia may be created.

Yet another aspect of the invention provides an apparatus for making ammonia (NH3) where the hydrogen is absorbed via one surface of a working electrode to drive hydrogen oxidation and nitrogen reduction at an opposite surface of the electrode. In this aspect of the invention, the apparatus comprises a first chamber for containing a hydrogen containing electrolyte, and a second chamber for containing a nitrogen containing electrolyte. A working electrode isolates the first chamber from the second chamber, a first surface of the working electrode being exposed to the first chamber and a second surface of the working electrode being exposed to the second chamber. A counter electrode is exposed to the first chamber. A current source is coupled between the working electrode and the counter electrode for causing absorption of molecular hydrogen into the working electrode via the first surface. A reference electrode is exposed to the second chamber. A controller is coupled to the current source and comprises a measuring device coupled between the working electrode and the reference electrode for measuring a potential between the working electrode and the reference electrode. The measuring device may be any device for measuring such potential, such as a voltmeter, and may be incorporated into the controller, such as if the controller is integrated onto a chip and/or is microprocessor based. The control system is configured to perform the following acts when a hydrogen containing electrolyte is supplied to the first chamber and a non-aqueous nitrogen containing electrolyte is supplied to the second chamber:

(a) control the current applied between the working electrode and the counter electrode in the first chamber so as to cause absorption of molecular hydrogen into the working electrode via the first surface, wherein the molecular hydrogen is absorbed into the working electrode at a concentration such that the working electrode at the second surface thereof simultaneously oxidizes the absorbed molecular hydrogen to form hydrogen protons ($H^+$) and reduces the nitrogen to form nitride ions ($N^{3-}$), (b) measure with the measuring device the potential between the working electrode and the reference electrode, and (c) adjust the current applied between the working electrode and the counter electrode in the first chamber based on the measured potential between the working electrode and the reference electrode in the second chamber to adjust the concentration of molecular hydrogen absorbed in the working electrode towards a point whereat oxidation to $H^+$ and the reduction to $N^{3-}$ occur at net zero external current; and An ammonia trap is provided for capturing $H^+$ and $N^{3-}$ that react to form $NH_3$.

Generally, the invention may be characterized as broadly encompassing any method for making ammonia ($NH_3$) wherein hydrogen is oxidized and nitrogen is reduced at the same electrode, irrespective of whether it occurs simultaneously or sequentially. In this broad characterization of the invention, the method comprises: exposing an electrode comprising absorbed hydrogen to a nitrogen containing non-aqueous electrolyte; oxidizing the absorbed hydrogen at the electrode to form hydrogen protons ($H^+$); reducing the nitrogen at the electrode to form nitride ions ($N^{3-}$); and reacting the $H^+$ and the $N^{3-}$ to form $NH_3$.

Other aspects, features, and advantages of the present invention will become apparent from the following detailed description, the accompanying drawings, and the appended claims.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE INVENTION

Figure 1:
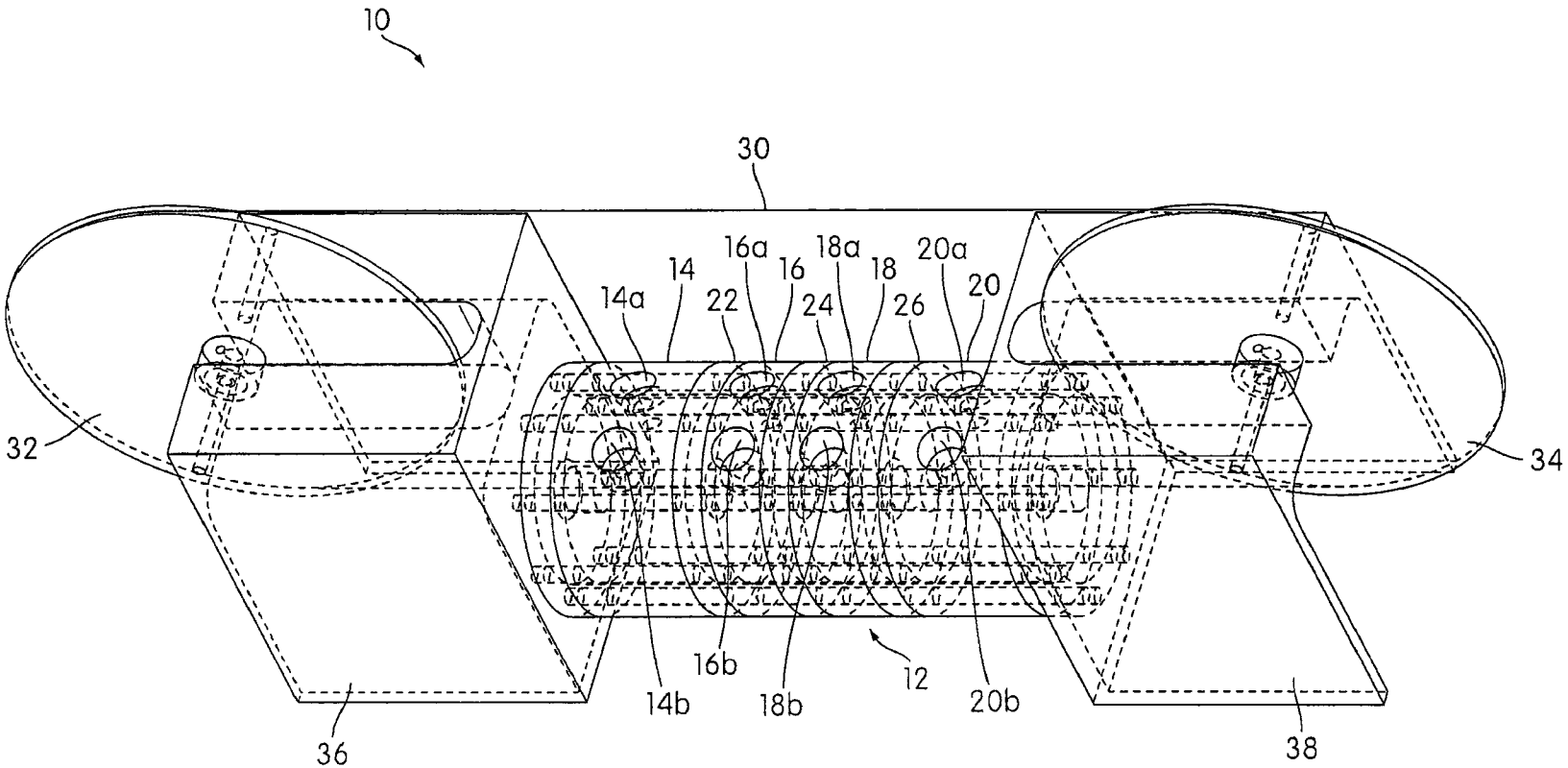
FIG. 1 is a schematic perspective view of an embodiment of an apparatus for generating ammonia.

An apparatus 10 according to an embodiment of the present invention is illustrated in FIG. 1. As shown in FIG. 1, the apparatus 10 includes a housing 12 that includes a plurality of chambers, including a first chamber 14, a second chamber 16, a third chamber 18, and a fourth chamber 20. As illustrated, the first chamber 14 and the second chamber 16 may be separated by a first separator 22, the second chamber 16 and the third chamber 18 may be separated by a second separator 24, and the third chamber 18 and the fourth chamber 20 may be separated by a third separator 26. The separators 22, 24, and 26 are each connected to the housing 12 so as to form an air tight seal between each separator and the housing 12.

Although the housing 12 is illustrated as having a generally cylindrical shape, other shapes may be used in accordance with the present invention. For example, in some embodiments, the housing 12 may have a generally rectangular shape. The illustrated embodiment is not intended to be limiting in any way.

As illustrated in FIG. 1, the apparatus 10 also includes a working electrode 30 that is configured to be exposed to all of the chambers 14, 16, 18, and 20 of the housing 12. In the illustrated embodiment, the electrode 30 is a continuous piece of wire that is routed around a first wheel 32 that is located near one end of the housing 12, and a second wheel 34 that is located on an opposite end of the housing 12 as the first wheel 32 such that the electrode 30 extends through all of the chambers 14, 16, 18, 20. The first wheel 32 is rotatably mounted to a first frame 36, which also supports one end of the housing 12, and the second wheel 34 is rotatably mounted to a second frame 38, which also supports another end of the housing 12. The wheels 32, 34 are sized and positioned to provide tension to the electrode 30, while causing the electrode 30 to move through the housing 12, as discussed in further detail below. At least one of the wheels may be driven by a motor (not shown) or any other suitable driving mechanism. In general, the electrode may have any configuration and may be moved by any suitable means. Additional examples of possible configurations are a flat ribbon instead of a wire, and a flat plate oscillated between chambers rather than driven by spools. The illustrated wheel system should not be regarded as limiting.

The electrode 30 may comprise a material that is efficient in storing atomic hydrogen (H), particularly at atmospheric conditions. Thus, the electrode 30 may also be referred to as a hydrogen-receiving electrode, or a working electrode, as discussed in further detail below. In an embodiment, the electrode 30 comprises palladium (Pd), which may be capable of storing approximately 900 times its volume of atomic hydrogen at atmospheric conditions. The electrode may be a Pd alloy. In a further embodiment, the electrode 30 consists essentially of palladium, i.e., is made from palladium, but may include small amounts of other metals and impurities that do not significantly impede the storage capacity of the palladium. Of course, other suitable hydrogen receptive materials may be used and embodiments of the invention are not limited to Pd. In an embodiment, the electrode 30 is porous so that the surface area of the electrode 30 may be increased. It is also contemplated that the electrode 30 may be a continuous piece of ribbon or any other shape that provides a large surface area to volume ratio. The illustrated embodiment is not intended to be limiting in any way.

Figure 2:
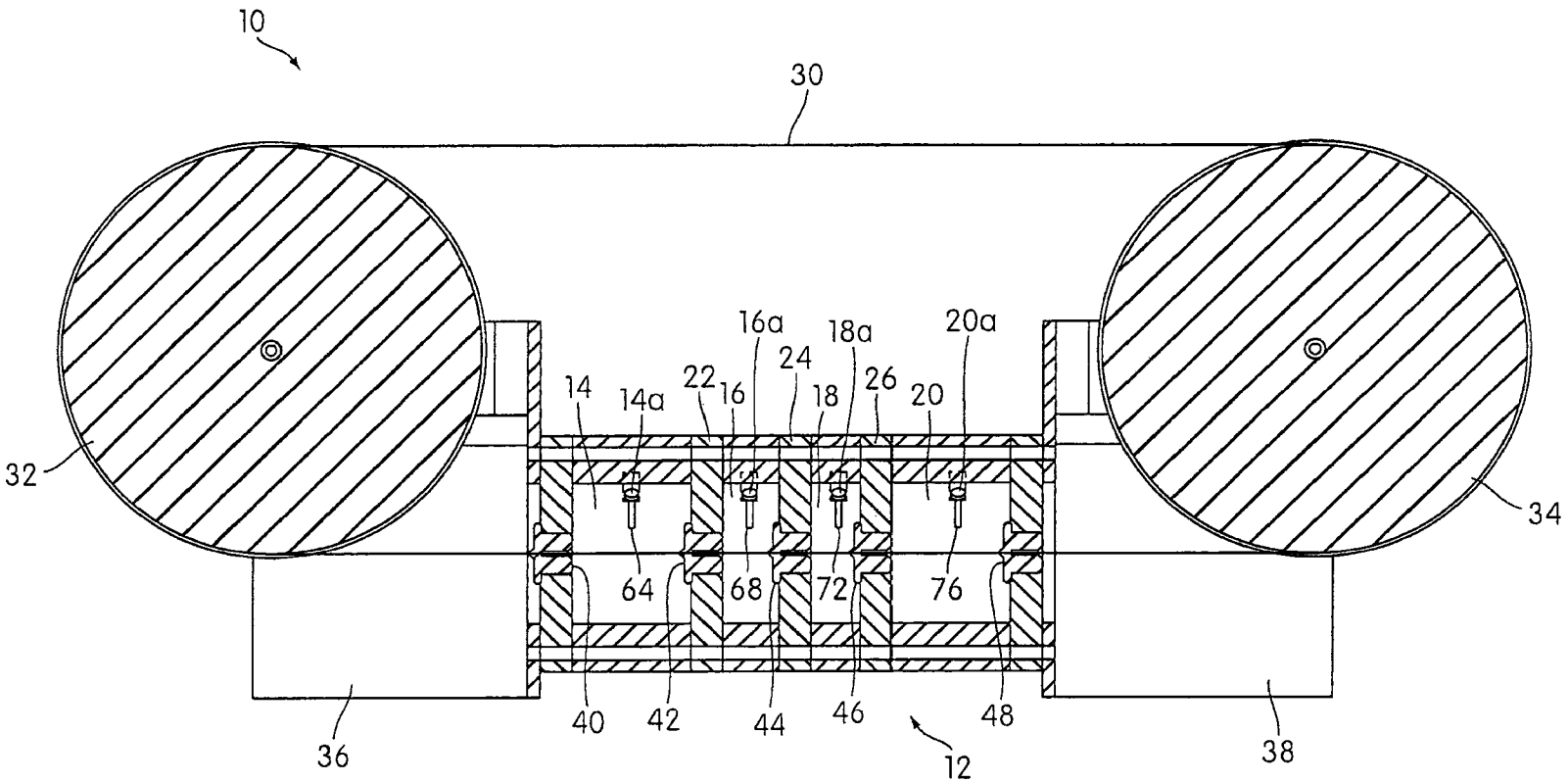
FIG. 2 is a schematic cross-sectional view of the apparatus of FIG. 1.
Figure 3:
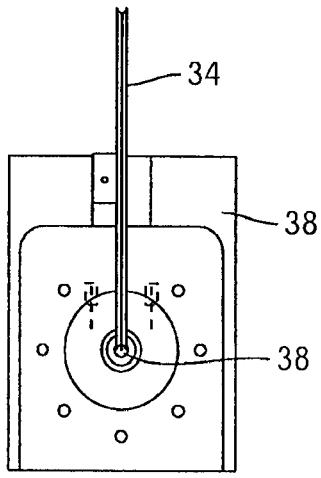
FIG. 3 is a schematic end view of the apparatus of FIG. 1.

As shown in FIG. 2, a plurality of seals 40, 42, 44, 46, 48 are used to engage the electrode 30 and provide a seal as the electrode 30 passes through the chambers 14, 16, 18, 20. Each seal 42, 44, 46 is constructed and arranged to provide a seal so that the contents of one chamber cannot enter the next chamber. Likewise, each seal 40, 48 is constructed and arranged to provide a seal so that the contents of the first and fourth chambers 14, 20 cannot exit the housing 12.

Figure 4:
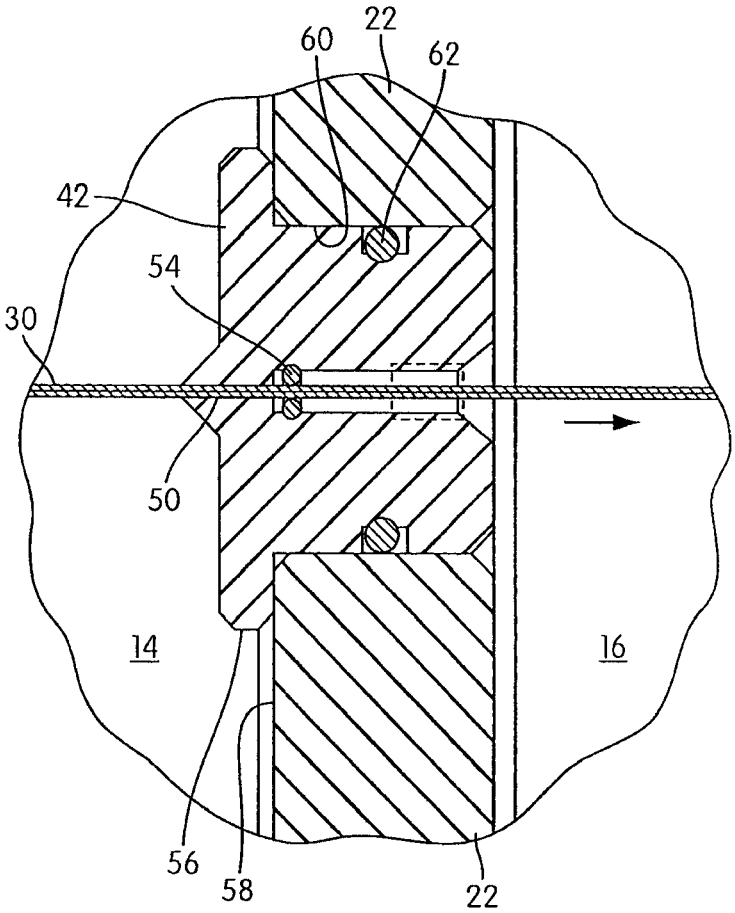
FIG. 4 is a detailed view of a seal between two chambers of the apparatus of FIG. 1.

FIG. 4 illustrates the seal 42 that is located between the first and second chambers 14, 16 in greater detail. It should be understood that the other seals 40, 44, 46, 48 may have the same or substantially the same construction, so further details of the other seals 40, 44, 46, 48 will not be described herein. The seal 42 may be made from a rubber or an elastomeric or polymeric material. As illustrated, the seal 42 includes a bore 50 that is sized to engage the electrode 30 in a sealing manner, yet still allow the electrode 30 to move therethrough. The seal 42 also includes a secondary seal 54, in the form of an o-ring that is constructed and arranged to engage the electrode 30 in a sealing manner at a position that is away from the first chamber 14 and toward the second chamber 16 relative to the bore 50, as illustrated. This arrangement allows the seal 42 to also wipe excess material from the electrode 30 so that the electrode 30 is substantially dry, i.e., does not have excess fluid, as it enters the next chamber. Such a feature may help minimize contamination between the chambers 14 and 16, which may improve the overall yield and efficiency of the apparatus 10.

The seal 42 also includes a flange 56 that is constructed and arranged to engage an interior surface 58 of the first chamber 14 that is defined by the separator 22. The flange 56 may help to seal the contents of the first chamber 14 from passing through an opening 60 in the separator 22 that receives the seal 42, as the electrode 30 moves in a direction denoted by the arrow in FIG. 4. The seal 42 may also include another secondary seal 62, in the form of an o-ring, that is constructed and arranged to engage the seal 42 and the separator 22, as shown in FIG. 4. Of course, other arrangements for the seals 40, 42, 44, 46, 48 are contemplated. The illustrated embodiment should not be considered to be limiting in any way.

In an embodiment, the first chamber 14 is constructed and arranged to hold hydrogen. More specifically, the first chamber 14 is constructed and arranged to hold a hydrogen-containing electrolyte that includes hydrogen. In an embodiment, the hydrogen-containing electrolyte is an aqueous solution, that may include water ($H_2O$) and a salt, such as sodium chloride, that is dissolved in the water. Other hydrogen-containing electrolytes may be used, such as methanol. The invention is not limited to any particular electrolyte.

Figure 5:
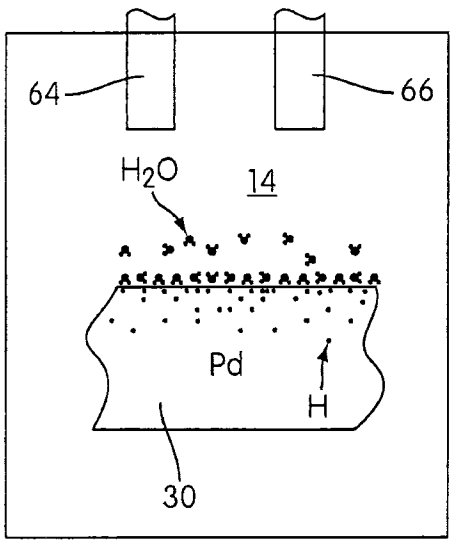
FIG. 5 is a schematic diagram of an electrochemical reaction in a chamber of the apparatus of FIG. 1.

A counter electrode 64 and a reference electrode 66 (shown in FIG. 5) may be inserted into the first chamber 14 through ports 14*a*, 14*b* (shown in FIG. 1) so that they are in contact with the hydrogen-containing electrolyte. The reference electrode 66 may be a saturated calomel electrode (SCE), which allows the potential that is created within the first chamber 14 when a current is applied to the counter electrode 64 to be measured relative to the SCE. The reference electrode 66 may be used to measure the potential created between the working electrode 30 and the reference electrode 66.

The use of the SCE should not be regarded as limiting, and its use is selected solely to provide easy point of reference. Thus, any reference electrode could be used (e.g., a standard hydrogen electrode), and the references to the SCE herein are solely for providing a standard point of reference. In some embodiments where analysis and measurement of the potentials is not needed, the presence of a reference electrode may be eliminated (although the potentials occurring may be described in terms relative to a reference electrode for purposes of having a point of reference).

A catalytic process known as underpotential deposition ("UPD") may be used to extract H from the aqueous solution and form a monolayer of H on the Pd electrode 30. The H may then be rapidly absorbed by the electrode 30, thereby allowing for another layer of H to replenish the surface of the electrode 30 as H travels into the Pd or other metal. The potentials used for UPD in this environment are above the reversible potential for reduction of hydrogen to its molecular form ($H_2$). In an embodiment, a suitable current may be applied to the counter electrode 64 to create a potential that allows for UPD to take place on the working electrode 30. The potential may be in the range of about −1100 to 200 mV versus SCE. Preferably, the potential is in the range of about −400 to 100 mV versus SCE, and more preferably, in a pH=1 electrolyte, the potential is about −200 mV. In an embodiment, the current efficiency in the first chamber 14 may be about one, because most, if not all of the hydrogen that is produced within the first chamber 14 is produced at the electrode 30 and may be consumed by absorption into the electrode 30 rather than be converted to $H_2$ gas.

In an embodiment, electrolysis or hydrolysis may be used to dissociate the hydrogen from the hydrogen-containing electrolyte, and allow the hydrogen to be absorbed by the electrode 30. In an embodiment, ionic hydrogen may be provided to the first chamber 14 and absorbed by the electrode 30. The above-described embodiments should not be considered to be limiting in any way. For example, atomic hydrogen may be provided to the electrode 30 by other means. In an embodiment, gas phase absorption may be used to load the electrode 30 with atomic hydrogen.

With the hydrogen absorbed therein, the electrode 30 may then pass through the seal 42 at separator 22 and into the second chamber 16. The seal 42 may be used to generally wipe off any excess aqueous solution that is on the surface of the electrode 30 so that the aqueous solution is not carried into the second chamber 16. In an embodiment, the second chamber 16 may hold a non-aqueous solution that allows any excess aqueous or other hydrogen-based solution that travels past the seal 42 to be removed (i.e., "washed" or "cleaned") from the electrode 30 before the electrode 30 enters the third chamber 18. Examples of such non-aqueous solutions include, but are not limited to, dimethyl sulfoxide, acetonitrile, tetrahydrofuran, propylene carbonate, nitro ethane, trimethyl phosphate, pyridine, and dimethyl formamide.

Movement of the electrode 30 through the second chamber 16 may create enough turbulence at the surface of the electrode 30 to cause any remaining aqueous solution to separate from the electrode 30 and mix in with the non-aqueous solution. In an embodiment, the second chamber 16 may be provided with a counter electrode 68 and a reference electrode (not shown) via ports 16*a*, 16*b* so that a suitable potential may be created between the reference electrode and the working electrode 30, to facilitate removing any remaining aqueous solution from the working electrode 30. Specifically, a suitable potential may be used to break down any remaining aqueous solution, such as water, that is on the electrode 30. The second chamber 16 should be considered to be optional, and may be used to improve the efficiency of the reaction that occurs in the third chamber 18.

The electrode 30 may then pass through the seal 44 at separator 24 and into the third chamber 18. In an embodiment, the third chamber 18 is constructed and arranged to hold a nitrogen-containing electrolyte that includes nitrogen. The nitrogen-containing electrolyte preferably has an electrochemical window that has a reduction potential of less than or equal to about −2000 mV as compared to the SCE, and an oxidation potential of greater than or equal to about 2000 mV as compared to SCE. In an embodiment, the nitrogen-containing electrolyte may include nitrogen gas ($N_2$) that is bubbled into a non-aqueous solvent (Sol in FIG. 6) that has a reduction potential of less than or equal to about −400 mV as compared to SCE. Examples of such non-aqueous solvents include, but are not limited to acetonitrile, tetrahydrofuran, propylene carbonate, dimethyl sulfoxide, nitro ethane, trimethyl phosphate, pyridine, and dimethyl formamide. The polarity of the solvent should preferably be large enough to adequately dissociate dissolved salts to an extent that is sufficient to provide conductivity throughout the solution. The nitrogen-containing electrolyte may also include a salt that has a reduction potential that is below the reduction potential used to reduce nitrogen so that the salt is not reduced in preference to the nitrogen. Likewise, the salt should have an oxidation potential that is above the oxidation potential used to oxidize hydrogen so that the salt is not oxidized in preference to the hydrogen (and the same applies to the solvent). In an embodiment, the salt has an electrochemical window with a reduction potential of −1000 mV versus SCE or less, and an oxidation potential of greater than 0 mV, preferably greater than 300 mV, versus SCE. These values may differ based on various parameters, such as temperature and pH.

Figure 6:
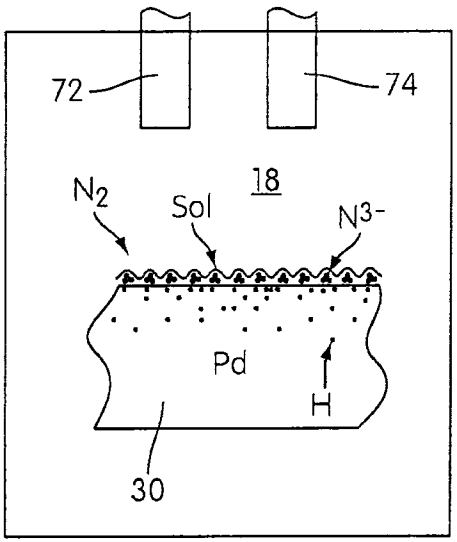
FIG. 6 is a schematic diagram of an electrochemical reaction in another chamber of the apparatus of FIG. 1.

A counter electrode 72 and a reference electrode 74 may be provided to the third chamber 16 via ports 16*a*, 16*b* so that the counter electrode 72 and the reference electrode 74 extend into the nitrogen-containing electrolyte. A current may be applied to the counter electrode 72 so that a suitable potential may be created between the working electrode 30 and the counter electrode 72 so that the nitrogen that is in the nitrogen-containing electrolyte may be reduced to nitride ions ($N^{3-}$) at the surface of the electrode 30, as shown in FIG. 6. The potential at the working electrode 30 should be selected to reduce the nitrogen to the nitride ions without reducing the atomic hydrogen within the electrode 30 to anionic hydrogen ($H^-$), i.e., the potential should be brought to a level that is below the potential at which nitrogen is reduced to $N^{3-}$, but held above the potential at which H is further reduced to $H^-$. The potential may be in the range of about −1100 to −250 mV versus SCE. Preferably, the potential is in the range of about −900 to −600 mV versus SCE, and more preferably, the potential is below or about −650 mV versus SCE. Of course, depending on the pH of the nitrogen-containing electrolyte, other preferred ranges may be used. The nitrogen-containing electrolyte is preferably anhydrous to maximize efficiency, and to avoid the presence of any hydrogen that will reduce in preference to the nitrogen.

In an alternative embodiment not illustrated, after the nitrogen has been reduced to nitride ions, the potential may be increased to a suitable level so that the hydrogen within the electrode 30 may be oxidized to cationic hydrogen ($H^+$) while the electrode is still in the same chamber where the nitrogen reduction took place. The potential may be in the range of about −400 to 300 mV versus SCE. Preferably, the potential is in the range of about −200 to 200 mV versus SCE, and more preferably, the potential is about 50 mV versus SCE. Because the oxidation of the $N^{3-}$ is slower than the oxidation of H, both $N^{3-}$ and $H^+$ will be present at the surface of the electrode 30 at the same time. The presence of the $N^{3-}$ and the $H^+$ may occur within an inner Helmholtz layer at the electrode surface. Once the $N^{3-}$ and $H^+$ are in the presence of each other, they will react to produce ammonia ($NH_3$), which may bubble through the nitrogen-containing electrolyte and be collected outside of the apparatus 10 through an evacuation tube (not shown), and separated from any $N_2$ that may have bubbled out of the electrolyte with the $NH_3$.

Figure 7:
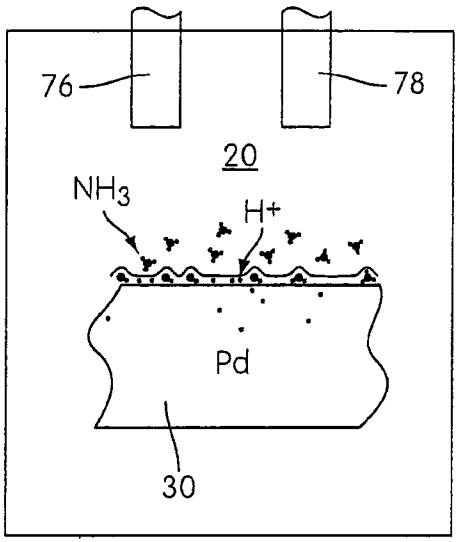
FIG. 7 is a schematic diagram of an electrochemical reaction in another chamber of the apparatus of FIG. 1.

In the illustrated embodiment, the reaction of hydrogen and reduced nitrogen to form ammonia occurs in a separate chamber. With the surface of the electrode 30 saturated with nitride ions, the electrode 30 may pass through the seal 46 of separator 26 and into the fourth chamber 20. A counter electrode 76 and a reference electrode 78 may be inserted into the chamber at ports 20*a*, 20*b* and into a suitable electrolyte that is held by the fourth chamber 20. Examples of suitable electrolytes for the fourth chamber 20 include, but are not limited to, dimethyl sulfoxide, acetonitrile, tetrahydrofuran, propylene carbonate, nitro ethane, trimethyl phosphate, pyridine, and dimethyl formamide. A suitable potential, which is higher than the potential used to reduce the nitrogen to nitride ions, may be created between the reference electrode and the working electrode 30 so that the hydrogen that is at or near the surface of the electrode 30 may be oxidized to create cationic hydrogen ($H^+$), as shown in FIG. 7. The potential may be in the range of about −400 to 300 mV versus SCE. Preferably, the potential is in the range of about −200 to 200 mV versus SCE, and more preferably, the potential is about 50 mV versus SCE. Because the oxidation of the $N^{3-}$ is slower than the oxidation of H, both $N^{3-}$ and $H^+$ should be present at the surface of the electrode 30 at the same time. Once the $N^{3-}$ and $H^+$ are in the presence of each other, they will react to produce ammonia ($NH_3$), which may be captured in the electrolyte and evacuated out of the fourth chamber 20. The use of this separate chamber is preferred, because the output should be essentially pure ammonia.

The electrode 30 may then pass through the seal 48 at the end of the housing 12, as shown in FIG. 2, out of the housing 12, around the second wheel 34, around the first wheel 32, through the seal 40 at the first end of the housing 12, and back into the first chamber 14, where the electrode 30 may be loaded once again with hydrogen. As long as the hydrogen-containing electrolyte and the nitrogen-containing electrolyte are replenished in their respective chambers 14, 18, the apparatus 10 may be used to run a continuous process to generate ammonia. The apparatus 10 may be generally operated at atmospheric conditions. Thus, in comparison to the high temperatures and high pressures of the prior art approaches, the present invention is capable of high energy efficiency relative to the amount of ammonia produced. Alternatively, the pressure and temperature of the individual chambers may be adjusted to maximize the efficiency of the apparatus 10. For example, the temperature may be in the range of about 10 to 150° C., and the pressure may be in the range of about 1 to 50 atmospheres.

It is also contemplated that the different counter electrodes 64, 68, 72, 76 may be turned off at any time so that the corresponding reactions do not take place in the respective chambers 14, 16, 18, 20. For example, it may be desirable to run the apparatus 10 so that only the electrode 30 is loaded with hydrogen in the first chamber 14. The electrode 30 may be pulled through the chambers at a low speed, while the counter electrodes 68, 72, 76 are turned off, thereby allowing the hydrogen ample time to be absorbed by the electrode 30. Then, it may be desirable to turn on the counter electrode 72 in the third chamber 18 and pull the electrode 30 at an increased speed while the nitrogen is reduced in the third chamber 18. Different combinations of counter electrodes being on and off are contemplated. The above-described embodiments should not be considered to be limiting in any way.

Figure 8:
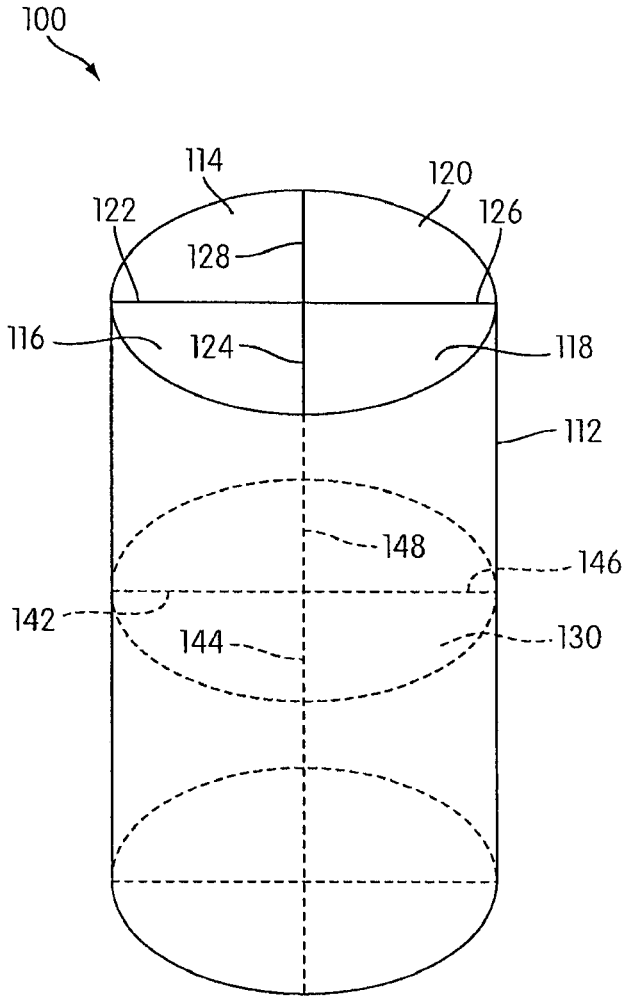
FIG. 8 is a schematic perspective view of another embodiment of an apparatus for generating ammonia.
Figure 9:
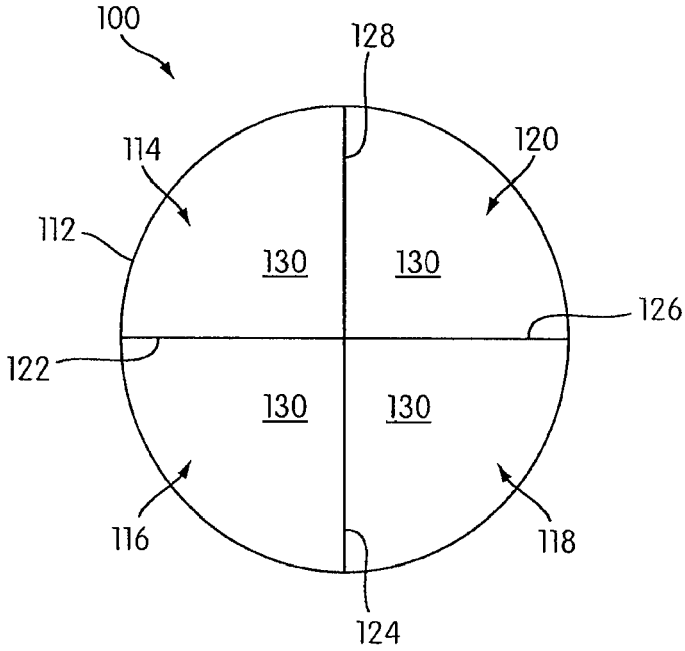
FIG. 9 is a schematic top view of the apparatus of FIG. 8.
Figure 10:
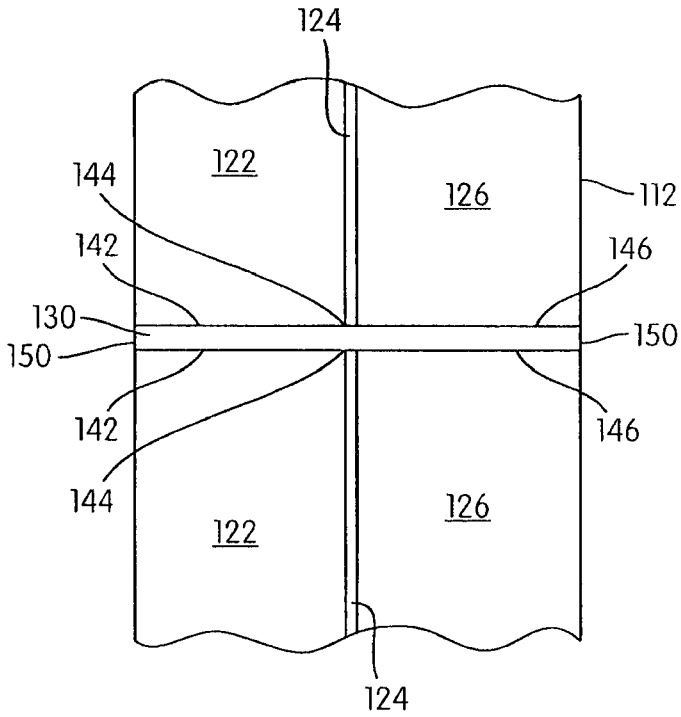
FIG. 10 is a schematic side view of a portion of the apparatus of FIG. 8.

An apparatus 100 according to another embodiment of the present invention is illustrated in FIGS. 8-10. As illustrated, the apparatus 100 includes a housing 112 that is substantially cylindrical in shape. The housing 112 defines a first chamber 114, a second chamber 116, a third chamber 118, and a fourth chamber 120, each of which has a cross-section that is substantially shaped like a piece of pie. A first separator 122 separates the first chamber 114 from the second chamber 116, a second separator 124 separates the second chamber 116 from the third chamber 118, a third separator 126 separates the third chamber 118 from the fourth chamber 120, and a fourth separator 128 separates the fourth chamber 120 from the first chamber, as shown in FIGS. 8 and 9.

As illustrated in FIG. 8, the apparatus 100 also includes an electrode 130 that is located toward the longitudinal center of the housing 112. The electrode 130 may be in the form of a rotating disc, and the chambers 114, 116, 118, 120 may be configured so that as the disc rotates, the electrode 130 is exposed to the different chambers 114, 116, 118, 120, in the same order discussed above with regard to the embodiment illustrated in FIGS. 1 and 2. Seals 142, 144, 146, 148 may extend from the separators 122, 124, 126, 128 that separate the chambers 114, 116, 118, 120 to prevent material that is in one chamber from being passed on to the next chamber. In addition, as shown in FIG. 10, a continuous outer seal 150 may be constructed and arranged to provide a seal between the electrode 130 and the housing 112.

The contents of the chambers 114, 116, 118, 120 may be the same or substantially the same as the contents of the chambers 14, 16, 18, 20 discussed above, and the electrode 130 may be rotated so that the electrode 130 is loaded with hydrogen in the first chamber 114, is washed in the second chamber 116, creates nitride ions at its surface in the third chamber 118, and creates ammonia in the fourth chamber 120, all in a single rotation of the electrode 130. Counter electrodes and reference electrodes (not shown) may be provided to each chamber, both above and below the electrode 130, if desired, so that the reactions discussed above may occur. The illustrated embodiment is not intended to be limiting in any way and is merely provided as an example of another configuration of the apparatus.

Figure 11:
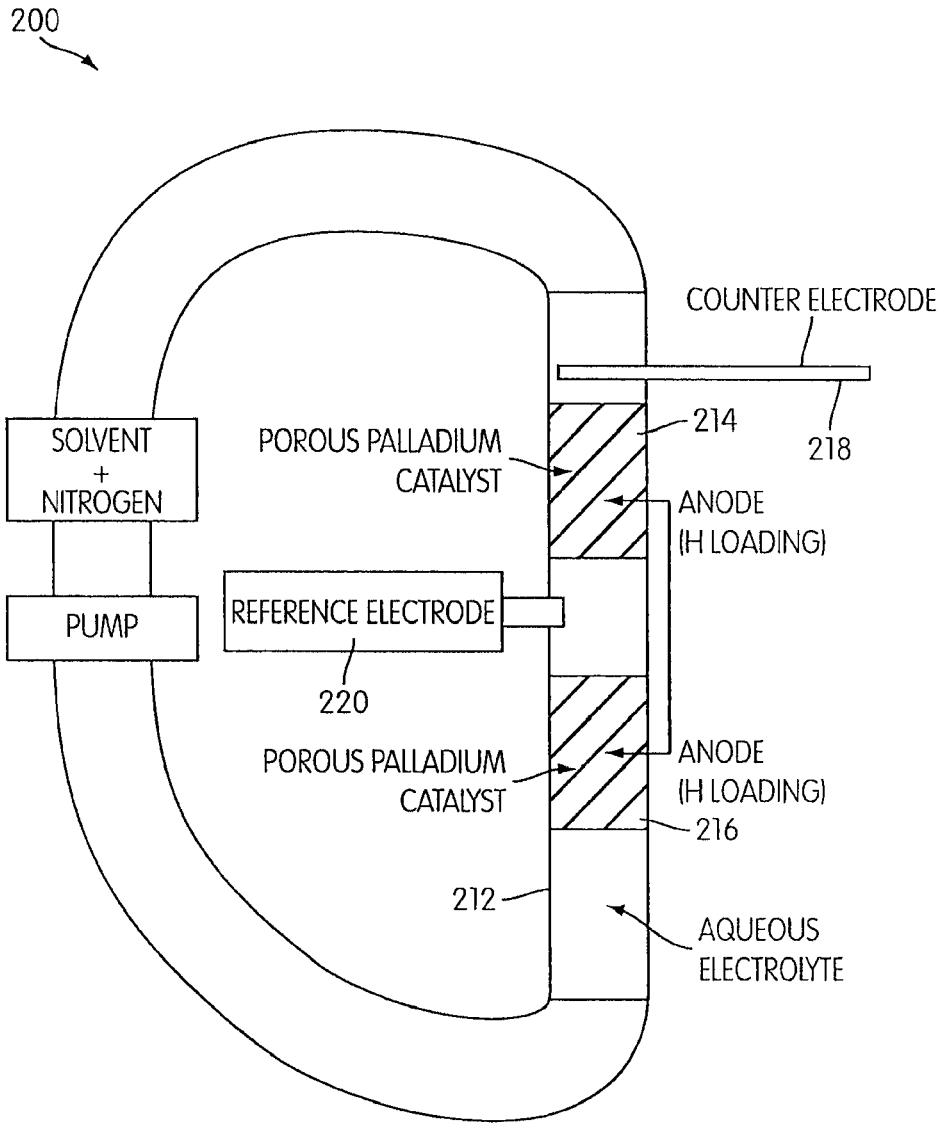
FIG. 11 is a schematic view of another embodiment of an apparatus for generating ammonia.
Figure 12:
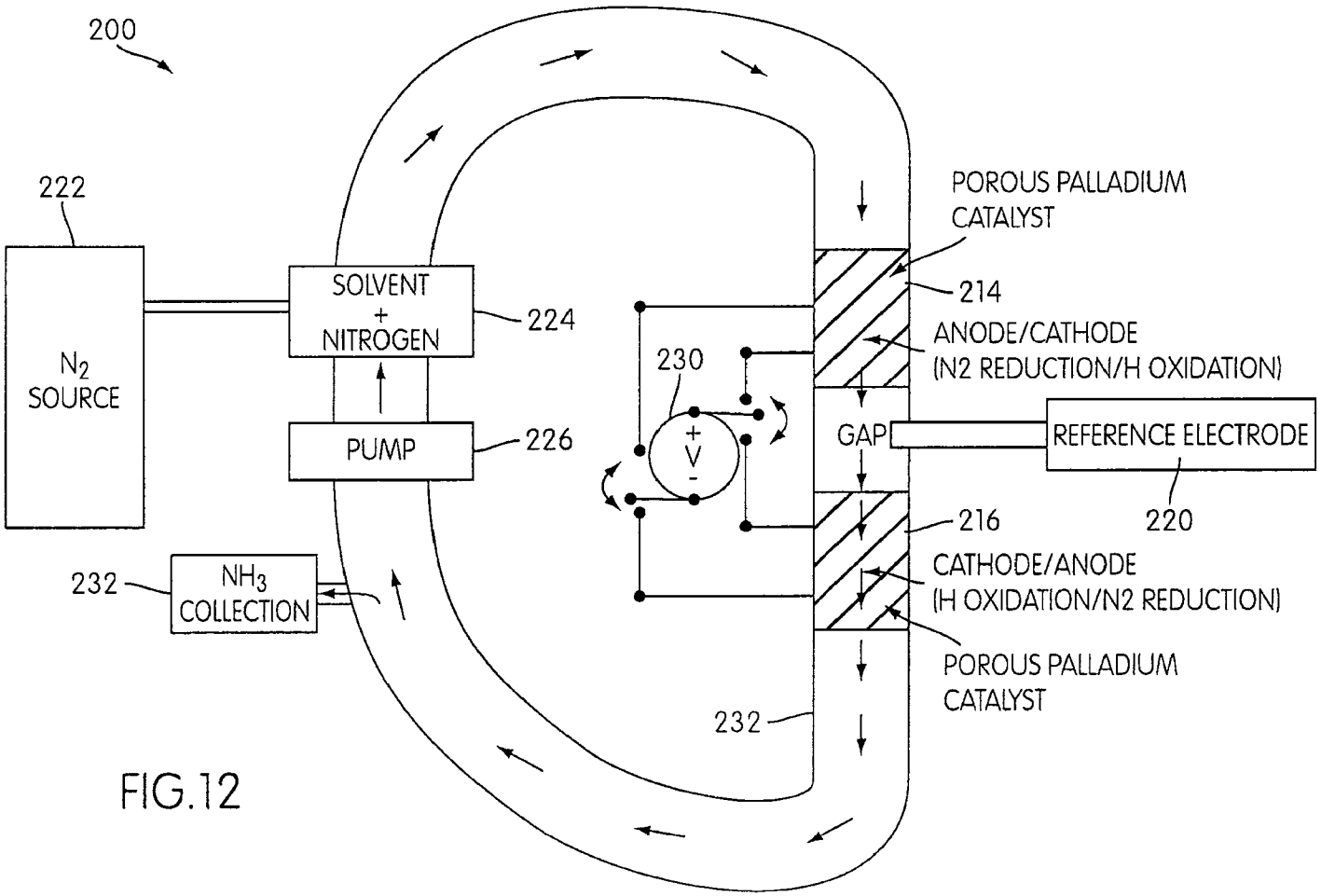
FIG. 12 is a schematic view of the apparatus of FIG. 11 during a different stage of the process.
Figure 13:
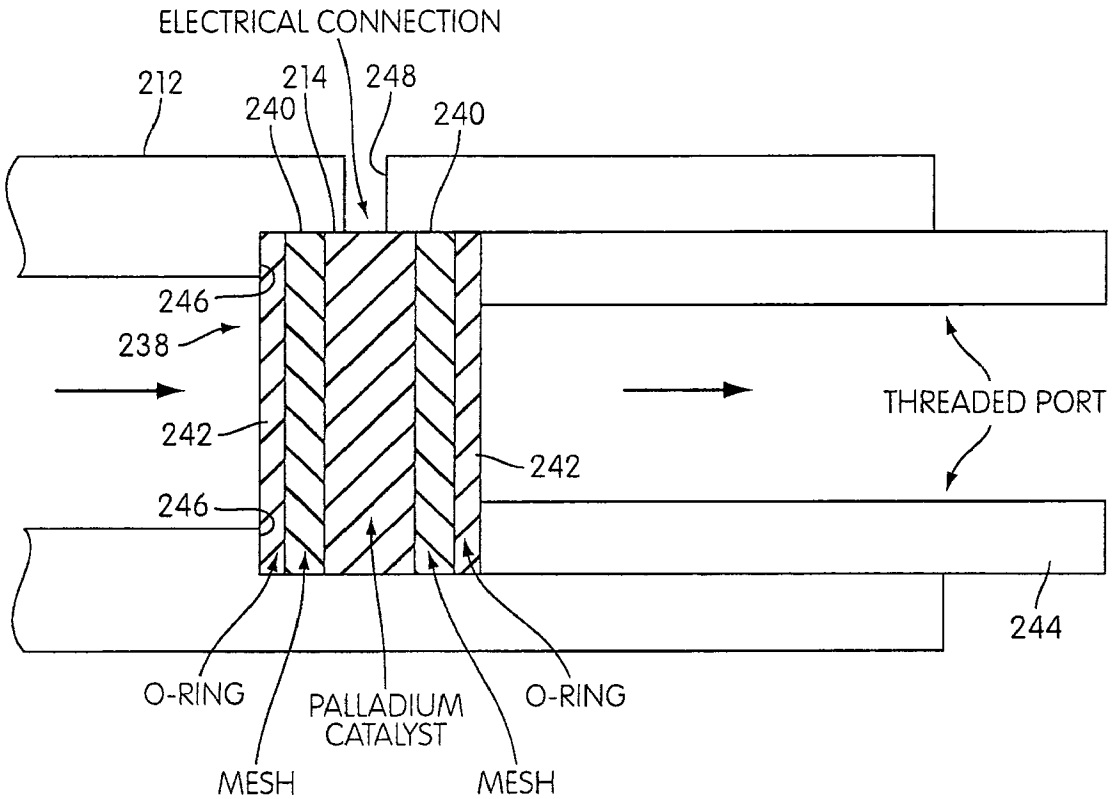
FIG. 13 is a detailed schematic view of an electrode mounted within a housing of the apparatus of FIG. 11.

An apparatus 200 according to yet another embodiment of the present invention is illustrated in FIGS. 11-13. In this embodiment, the apparatus 200 includes a housing 212 that may be substantially cylindrical in shape. The housing 212 may be constructed and arranged to be a reaction column that allows different electrolytes and solutions to pass therethrough. As illustrated, the apparatus 200 also includes an upper working electrode 214, and a lower working electrode 216, which are stationary relative to the housing 212. In this embodiment, rather than moving the working electrode to different chambers that contain the electrolytes described above, the electrolytes flow through the electrodes 214, 216 as different potentials are created within the apparatus, as described in further detail below. Valves may be used to control which electrolytes are flushing through. Like the prior electrodes, these working electrodes 214, 216 are made of Pd or some other hydrogen receptive material.

For example, as illustrated in FIG. 11, a hydrogen-containing electrolyte, preferably in the form of an aqueous electrolyte, may be allowed to flow into the housing 212 and through the working electrodes 214, 216, which are porous in this embodiment. Once the housing 212 has been filled with the hydrogen-containing electrolyte, a current may be applied to the counter electrode 218 so that a suitable potential is created between the counter electrode 218 and the working electrodes 214, 216. The reference electrode 220 is preferably an SCE, as discussed above. The potential created may be in the same range discussed above. Both of the electrodes 214, 216 act as anodes as the hydrogen is absorbed by the electrodes 214, 216. After the electrodes 214, 216 have been exposed to the hydrogen-containing electrolyte for a suitable amount of time to absorb as much hydrogen as possible, or some increment thereof, the hydrogen-containing electrolyte may be drained out of the housing 212. In an embodiment, the hydrogen-containing electrolyte may be circulated through the housing 212 in a similar manner as a nitrogen-containing electrolyte is circulated through the housing 212, as described in greater detail below.

Next, as an optional step, a non-aqueous solution may be passed through the housing 212 so that any residual water or other hydrogen-containing solution is "washed" or "cleaned" out of the housing 212. The counter electrode 218 and reference electrode 220 may be used to facilitate the cleaning of the working electrodes 214, 216 and the housing 212. As above, this step may be considered to be an optional step that may improve the overall efficiency of the system.

As illustrated in FIG. 12, a source of nitrogen ($N_2$) 222 may be connected to a source of non-aqueous solvent 224 so that the nitrogen may be bubbled into the solvent. A salt may also be mixed in with the solvent and nitrogen to create a nitrogen-containing electrolyte. A pump 226 may be used to circulate the nitrogen-containing electrolyte through the housing 212 in a continuous manner so that the nitrogen-containing electrolyte passes through the working electrodes 214, 216. A voltage source 230 is connected to both electrodes 214, 216 and is constructed and arranged to switch the direction of flow of current between the electrodes 214, 216 so that the upper electrode 214 becomes the anode as the lower electrode 216 becomes the cathode, and vice-versa. Because the nitrogen within the nitrogen-containing electrolyte will be reduced to nitride ions ($N^{3-}$) at the surface of the anode, and the hydrogen within the already hydrogen-loaded cathode will oxidize to cationic hydrogen ($H^+$), ammonia may be generated at each of the electrodes 214, 216, in the manner described above, as each electrode 214, 216 cycles between being an anode and a cathode. The reference electrode 220 is configured to measure the changing potential of the upper electrode 214.

The generated ammonia may travel with the nitrogen-containing electrolyte out of the housing 212 and into an ammonia collection chamber 232. If nitrogen travels into the chamber 232 with the ammonia, other known means to separate the ammonia from the nitrogen may be used. For example, if the effluent of nitrogen and ammonia is pressurized to a suitable level, the ammonia will turn from gas to a liquid, which may be collected. Thermal means may also be used to transform the ammonia to a liquid.

A detailed view of an electrode subassembly 238 that includes the upper electrode 214 is shown in FIG. 13. Although the upper electrode 214 is shown, another subassembly that includes the lower electrode 216 may have the same or substantially the same configuration. As illustrated, the electrode 214 is sandwiched between two pieces of mesh 240, which help protect the porous electrode 214 from being contaminated with particles that may clog the pores of the electrode 214. An o-ring 242 is positioned on the outside of each piece of mesh 240 to create a seal between the housing 212 and the electrode subassembly 238 mesh/electrode so that the hydrogen-containing electrolyte and the nitrogen-containing electrolyte will be forced through the electrode 214. A threaded port 244 is threadingly received by the housing 212 and is configured to clamp the electrode subassembly 238 against a surface 246 provided by the housing 212. As illustrated, an opening 248 is provided in the housing 212 so that an electrical connection to a voltage source, such as the source 230 shown in FIG. 12. The illustrated embodiment is not intended to be limiting in any way, and is provided as an example of how the electrode 214 may be positioned within the housing 212 so that the electrolytes discussed above may flow through the electrode 214.

The above-described and illustrated embodiments of the apparatus 10, 100, 200 are not intended to be limiting in any way. Indeed, alternative arrangements and configurations are contemplated and are considered to be within the scope of the present invention.

Figure 14:
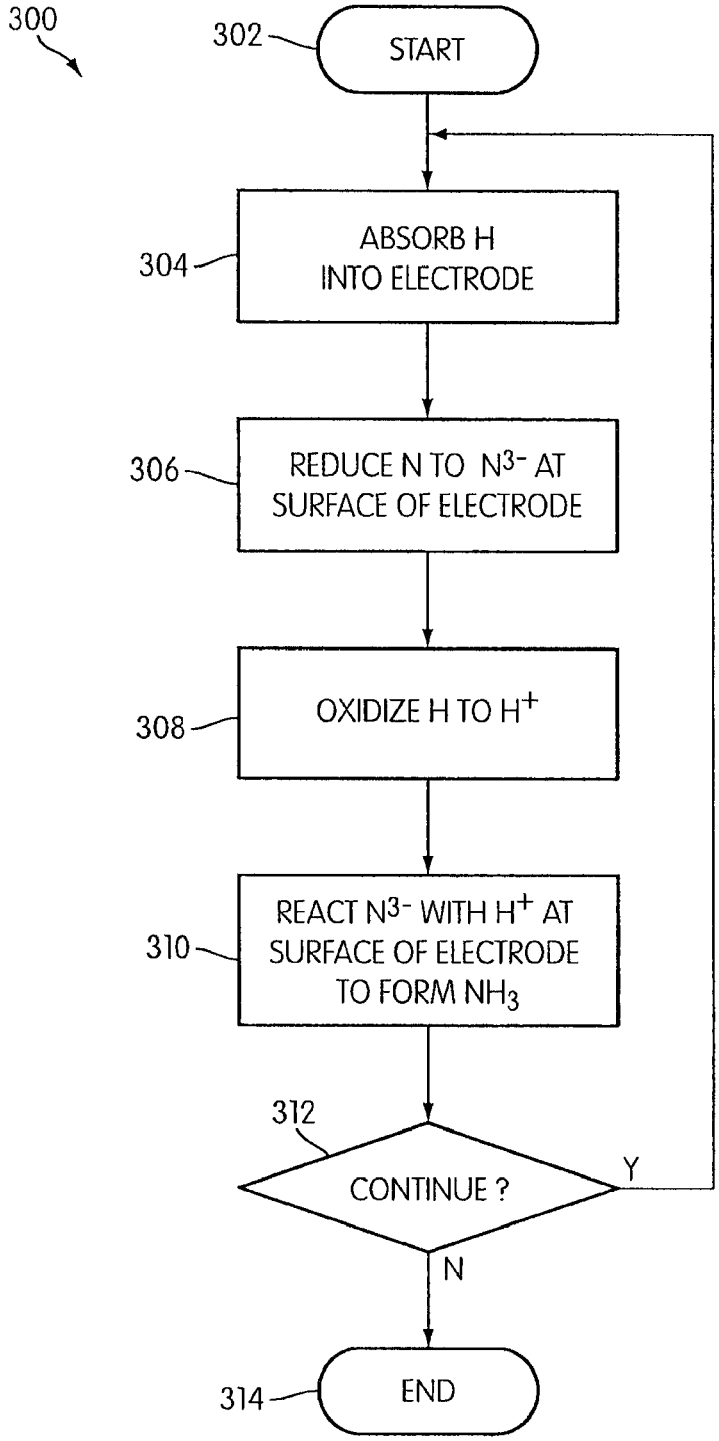
FIG. 14 is a flow chart of a method of generating ammonia in accordance with an embodiment of the present invention.
Figure 15:
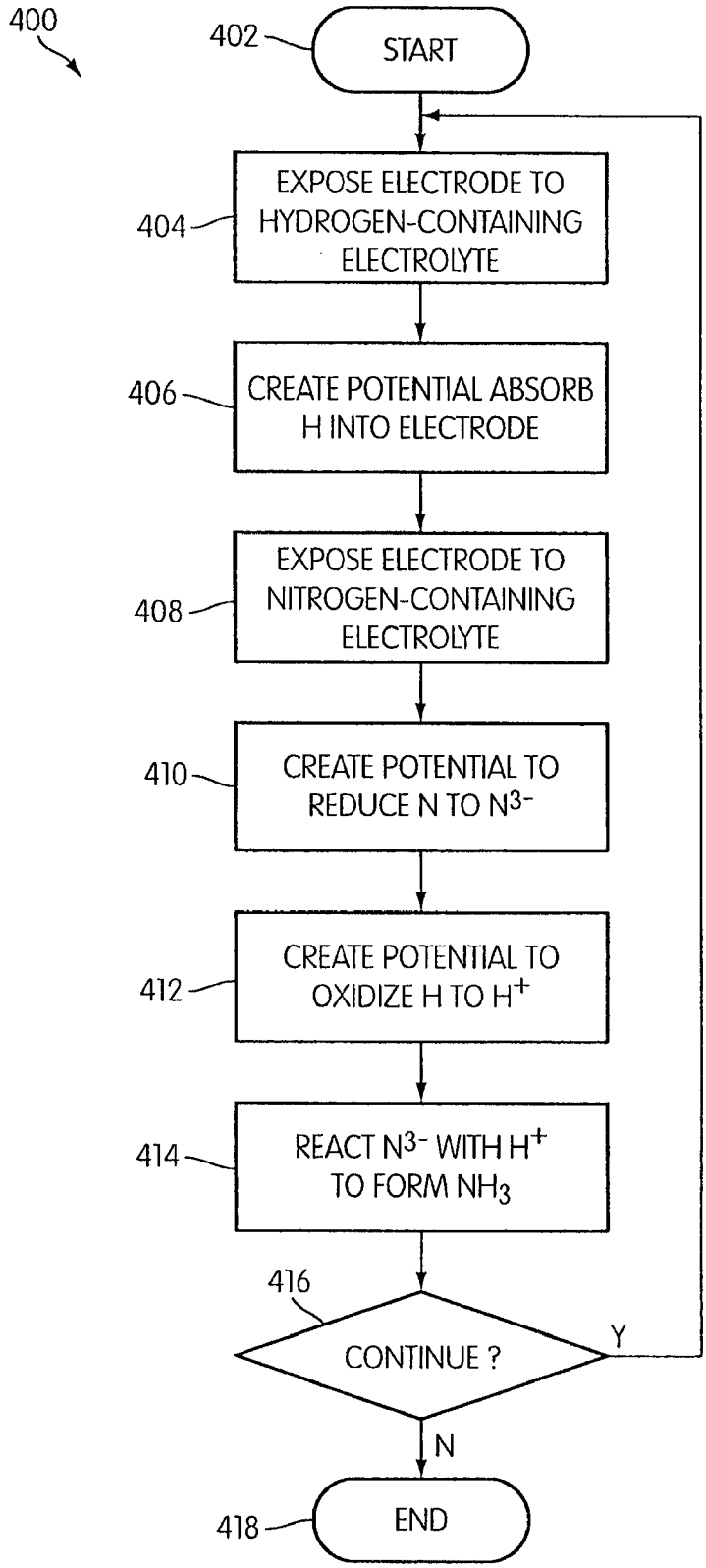
FIG. 15 is a flow chart of a method of generating ammonia in accordance with another embodiment of the present invention.

A method 300 of producing ammonia in accordance with an embodiment of the present invention is illustrated in FIG. 14. As shown, the method starts at 302. At 304, hydrogen is absorbed into an electrode. The electrode may be any of the electrodes 30, 130, 230 described above, but is not limited to such electrodes. The hydrogen may be absorbed into the electrode by any of the methods described above, as well as any other suitable method for absorbing hydrogen into an electrode. At 306, nitrogen is reduced to nitride ions at the surface of the electrode. The nitrogen may be reduced in accordance with any of the methods described above, as well as any other suitable method. The hydrogen that has been absorbed into the electrode is oxidized at 308. The hydrogen may be oxidized by using any method described above, or any other suitable method.

Once the nitrogen has been reduced to nitride ions, and the hydrogen has been oxidized, the nitride ions may react with the oxidized hydrogen at the surface of the electrode to form ammonia at 310. At 312, a decision is made whether to continue the method 300. If the method 300 is to be continued, the method returns to 304 and hydrogen is once again absorbed by the electrode. If the method is to be discontinued, the method ends at 314.

A method 400 of producing ammonia in accordance with another embodiment of the present invention is illustrated in FIG. 14. The method 400 starts at 402. At 404, an electrode, such as any of the electrodes 30, 130, 230 described above, although not limited to such electrodes, may be exposed to a hydrogen-containing electrolyte. At 406, a potential is created within an electrochemical cell that includes the electrode while the electrode is being exposed to the hydrogen-containing electrolyte so that atomic or ionic hydrogen may be absorbed by the electrode, such as in the manner described above. The hydrogen-containing electrolyte may include, but is not limited to any of the hydrogen-containing electrolytes described above.

After the hydrogen has been absorbed by the electrode, the electrode may be exposed to a nitrogen-containing electrolyte at 408. The nitrogen-containing electrolyte may include, but is not limited to the any of the nitrogen-containing electrolytes described above. While the electrode is being exposed to the nitrogen-containing electrolyte, a potential may be created in the electrochemical cell that is suitable to reduce the nitrogen in the nitrogen-containing electrolyte to nitride ions at 410. At 412, another potential may be created in the electrochemical cell that is suitable to oxidize the hydrogen to $H^+$.

Once the nitrogen has been reduced to nitride ions, and the hydrogen has been oxidized, the nitride ions may react with the oxidized hydrogen at the surface of the electrode to form ammonia at 414. At 416, a decision is made whether to continue the method 400. If the method 400 is to be continued, the method returns to 404 and the electrode is exposed to the hydrogen-containing electrolyte once again. If the method is to be discontinued, the method ends at 418.

It is contemplated that in some embodiments, the electrode may move relative to the different environments that contain the electrolytes discussed above, while in other embodiments, the environments may move relative to the electrode. Embodiments of the present invention contemplate any configuration in which the electrode is exposed to a hydrogen-containing electrolyte and a nitrogen-containing electrolyte, and suitable potentials are applied to the electrode as the electrode is exposed to the different electrolytes. The above-described embodiments are not intended to be limiting in any way.

Figure 16:
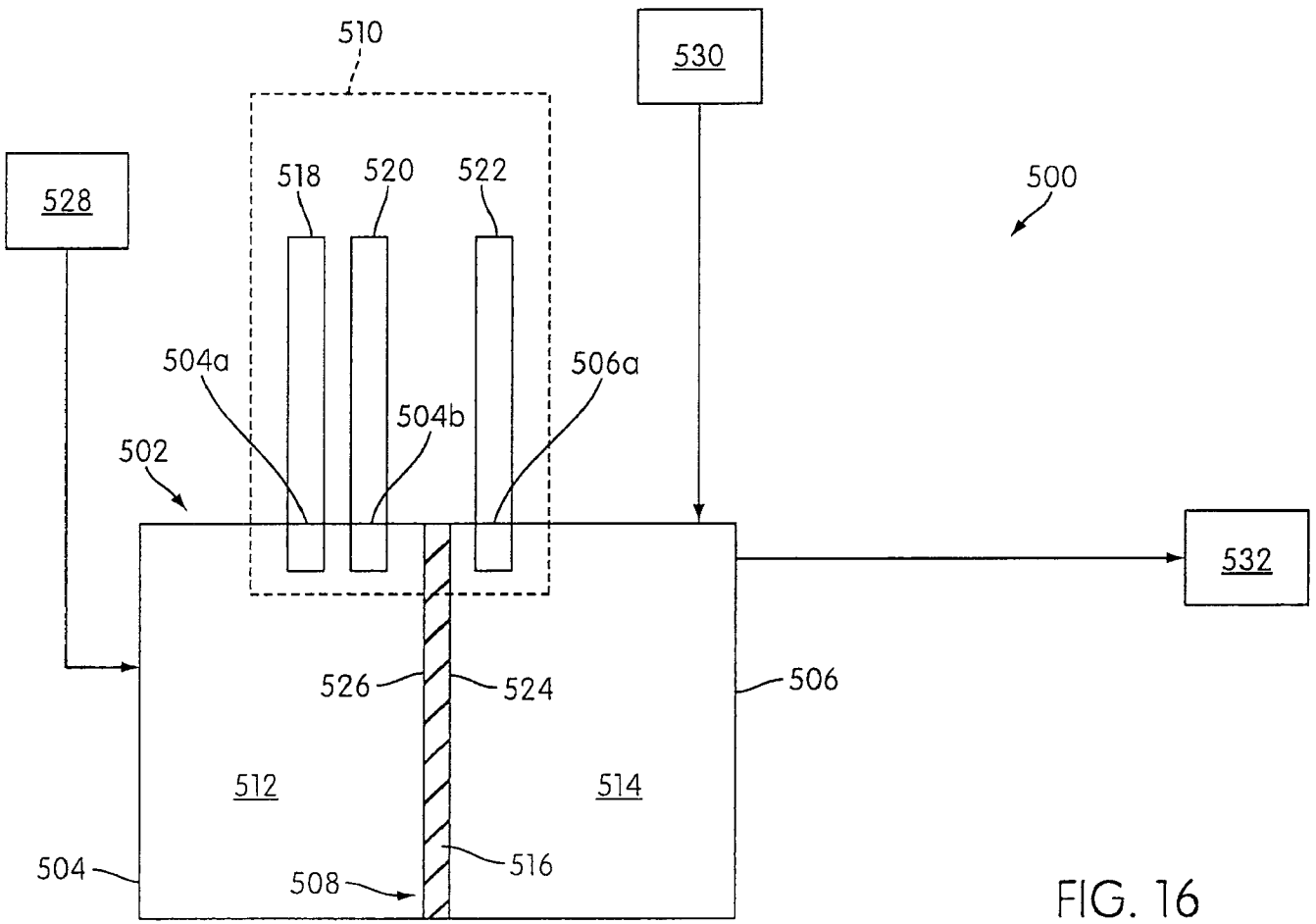
FIG. 16 is a schematic view of another embodiment of an apparatus for generating ammonia.

An apparatus 500 according to an embodiment of the present invention is illustrated in FIG. 16. As shown in FIG. 16, the apparatus 500 includes a housing 502 that includes a plurality of chambers, including a first chamber 504 and a second chamber 506. Although the housing 502 is illustrated as having a generally rectangular shape, other shapes may be used in accordance with the present invention. For example, in some embodiments, the housing 502 may have a generally cylindrical shape. The illustrated embodiment is not intended to be limiting in any way. As illustrated, the first chamber 504 and the second chamber 506 may be separated and sealed from one another by a separator 508. The separator 508 may be connected to the housing 502. The apparatus 500 includes an electrode system 510 in contact with the first chamber 504 and the second chamber 506, as described in further detail below.

The first chamber 504 is constructed and arranged to hold hydrogen. More specifically, the first chamber 504 is constructed and arranged to hold a hydrogen-containing electrolyte 512 that includes hydrogen. In an embodiment, the hydrogen-containing electrolyte 512 is an aqueous solution. For example, the hydrogen-containing electrolyte 512 may include water and a salt, such as sodium chloride, that is dissolved in the water, or the hydrogen-containing electrolyte 512 may include methanol. The invention is not limited to any particular hydrogen-containing electrolyte 512.

The second chamber 506 is constructed and arranged to hold nitrogen. More specifically, the second chamber 506 is constructed and arranged to hold a nitrogen-containing, non-aqueous (i.e., devoid of hydrogen) electrolyte 514 that includes nitrogen. In an embodiment, the non-aqueous electrolyte 514 may include dimethyl sulfoxide (DMSO). Other suitable non-aqueous electrolytes may be acetonitrile, tetrahydrofuran, propylene carbonate, nitro ethane, trimethyl phosphate, pridine, or dimethyl formamide. In an embodiment, the non-aqueous electrolyte 514 may include a salt, such as lithium chloride, potassium hexafluorophosphate, sodium triflate, sodium fluoride, or sodium chloride. The electrolyte (including its salt and solvent) should preferably be stable and not reduce or oxidize at the potentials used in the process. The invention is not limited to any particular non-aqueous electrolyte 514.

The separator 508 may comprise a material that is efficient in storing atomic hydrogen (H), and may also be referred to as a working electrode 516. In an embodiment, the working electrode 516 comprises palladium (Pd). In a further embodiment, the working electrode 516 consists essentially of palladium, i.e., is made from palladium, but may include small amounts of other metals and impurities that do not significantly impede the storage capacity of the palladium. Of course, other suitable materials may be used. For example, the working electrode 516 may comprise a metal or metal alloy, including but not limited to palladium, palladium-silver, nickel, iron, ruthenium, titanium, copper, platinum, iridium, gold, vanadium, chromium, tungsten, or cobalt. The working electrode 516 may take many forms. In the illustrated embodiment, the working electrode 516 is a membrane. Yet, the illustrated embodiment is not intended to be limiting in any way.

As illustrated in FIG. 16, the electrode system 510 may be configured to be exposed to both the first chamber 504 and the second chamber 506 of the housing 502. In general, the electrode system 510 may have any configuration. In the illustrated embodiment, the electrode system 510 comprises four electrodes including a first reference electrode 518, a counter electrode 520, a second reference electrode 522, and the working electrode 516. Each of the reference electrodes 518, 522 are coupled to the working electrode with a measuring device therebetween for purposes of measuring the potential between the working electrode 516 and the respective reference electrode 518, 522. The first reference electrode 518 and the counter electrode 520 are exposed to the first chamber 504 of the housing 502. The first reference electrode 518 and the counter electrode 520 may be inserted into the first chamber 504 through ports 504*a*, 504*b* (shown in FIG. 16) so they are in contact with the hydrogen-containing electrolyte 512. The second reference electrode 522 may be exposed to the second chamber 506 of the housing. The second reference electrode 522 may be inserted into the second chamber 506 through a port 506*a* (shown in FIG. 16) so it is in contact with the non-aqueous electrolyte 514. In the embodiment, the second reference electrode 522 extends into the non-aqueous electrolyte 514.

The first reference electrode 518 may be an SCE, which allows the potential that is created within the first chamber 504 when a current is applied to the counter electrode 520 to be measured relative to the SCE. The second reference electrode 522 may also be an SCE, which allows the potential that is created within the second chamber 506 across the second reference electrode 522 and a surface 524 of the working electrode 516 to be measured relative to the SCE. The use of the SCE should not be regarded as limiting, and its use may be selected solely to provide a point of reference. Thus, any type of reference electrode may be used for the first reference electrode 518 and the second reference electrode 522.

The catalytic process known as underpotential deposition ("UPD"), discussed above, may be used to extract H from the hydrogen-containing electrolyte 512 and form a monolayer of H on a surface 526 of the working electrode 516. The H may then be rapidly absorbed by the working electrode 516, thereby allowing for another layer of H to replenish the surface 526 of the working electrode 516 as H travels into the working electrode 516 from the hydrogen-containing electrolyte 512. Current may be applied to the counter electrode 520 by a power source between the working electrode and the counter electrode to create a potential that allows for UPD to take place on the working electrode 516.

In an embodiment, electrolysis or hydrolysis may be used to dissociate the hydrogen from the hydrogen-containing electrolyte 512, and allow the hydrogen to be absorbed by the working electrode 516. In an embodiment, ionic hydrogen may be provided to the first chamber 504 by a hydrogen source 528 and absorbed by the working electrode 516. The above-described embodiments should not be considered to be limiting in any way. For example, atomic hydrogen may be provided to the working electrode 516 by other means including any of the methods described with respect to the previous embodiments.

The reversible potential for hydrogen oxidation out of the working electrode 516 at surface 524 may be proportional or correlated to the concentration of hydrogen absorbed within the working electrode 516 and the proton activity in the non-aqueous electrolyte 514 at the surface 524. By controlling the concentration of interstitial hydrogen within the working electrode 516 and decreasing the proton activity in the non-aqueous electrolyte 514 at the surface 524, the reversible potential for hydrogen oxidation at surface 524 can be driven far negative (i.e., cathodic) of the standard hydrogen reduction-oxidation potential for $H_2 \leftrightarrows 2H^+ + 2e^-$. And, more preferably, it can be driven cathodic of the reduction-oxidation potential for $3N_2 + 6e^- \leftrightarrows 2N^{3-}$. This can even be achieved at or near standard conditions (i.e., room temperature and 1 atm. pressure). No specific level of either variable is required, but on balance, the hydrogen concentration should be sufficiently high and the proton activity should be sufficiently low to enable this cathodic shifting of the hydrogen reduction-oxidation potential. Thus, if the proton activity is very low, a lower hydrogen concentration would be sufficient, and the requisite hydrogen concentration will increase as the proton activity increases. The vice versa holds true for the proton activity based on the level of hydrogen concentration. Most preferably, this is done so that the oxidation of hydrogen and reduction of nitrogen occur spontaneously without requiring additional electrical (or other) work to drive the reactions.

In an embodiment, a gas source 530 may transfer the nitrogen into the non-aqueous electrolyte 514. The gas source may take several forms, such as a nitrogen gas sparge source. The rate of gas sparged into the non-aqueous electrolyte 514 may be controlled to ensure an adequate amount of nitrogen for consumption by the overall ammonia generation reaction. Sparging may also create beneficial circulation in chamber 506 to ensure that any excess $H^+$ ions present at the electrode surface 524 do not suppress the reaction.

In an embodiment, the proton activity in the non-aqueous electrolyte 514 may be reduced by applying a cathodic potential to the working electrode 516, or by adding proton complexing agents to the non-aqueous electrolyte 514. In an embodiment, the proton activity may be reduced prior to exposing the working electrode 516 to the non-aqueous electrolyte 514. Because the reaction at surface 524 is correlated to both the proton activity in electrolyte 516 and the hydrogen concentration in electrode 516, it is not necessary to reduce the proton activity (as the hydrogen concentration may instead be increased to achieve the same general effect).

To generate ammonia from the hydrogen absorbed in the electrode 516 and the nitrogen dissolved in the electrolyte 514, at least one potential that is simultaneously both anodic of the oxidation potential for hydrogen and cathodic of the reduction potential for $N_2$ is applied to the electrode 516. Protons ($H^+$) are released into the non-aqueous electrolyte 514 from the working electrode 516, while nitrogen is reduced to nitride ions ($N^{3-}$) at the same surface 524. By regulating the potential at which the working electrode 516 is held, a net zero external current condition can be reached where three $H^+$ protons are released from the working electrode 516 for every nitride ($N^{3-}$) ion formed, thereby forming ammonia.

The simultaneous reactions occurring at this potential(s) are as follows:

$$6H_{Pd} \rightarrow 6H^+ + 6e^-$$

$$3N_2 + 6e^- \rightarrow 2N^{3-}$$

$$2N^{3-} + 6H^+ \rightarrow NH_3$$

While an optimal balance of three $H^+$ for every $N^{3-}$ is desirable, it is acceptable to be substantially close to that optimal balance and perfection need not necessarily be achieved. Preferably, the process operates within +/−100 microamperes per square centimeter of net zero external current. If there is to be an imbalance, it is preferable that the imbalance be at a potential cathodic of that balanced net zero external current point. This will cause generation of excess nitride ions, which will better ensure consumption of $H^+$ ions released from the electrode. If the potential is anodic of that point, then excess $H^+$ protons not consumed by $N^{3-}$ to form ammonia may be released into the electrolyte 514, which over time can increase its proton activity and shift the reduction-oxidation potential for $H_{Pd} \leftrightarrows H^+ + e^-$ in the anodic direction. This will reduce the efficiency of the process, and if uncontrolled over time may shift the $H_2$ reduction-oxidation potential so far that it is anodic of that for nitrogen, thus removing the available window for enabling simultaneous reduction of nitrogen and oxidation of hydrogen at the same electrode.

Optimally, the concentration of hydrogen in the working electrode 516 and the proton activity on the electrolyte 514 may be maintained at sufficient levels such that the hydrogen oxidation, nitrogen reduction and ammonia formation occur spontaneously without the need to apply a current (positive or negative) to the electrode 516. That is, the concentrated hydrogen in the working electrode relative to the electrolyte's low proton activity will create a natural cathodic potential at the electrode. Thus, the application of at least one potential to the electrode 516 need not be from an external power source, and instead the at least one potential can be applied by the natural electrochemical behavior between the concentrated hydrogen in the electrode 516 and the proton activity of the nitrogen-containing electrolyte 514. And, as mentioned above, the rate of electrons generated by the hydrogen oxidation is preferably equal to the rate consumed by the nitrogen reduction; and thus no current from a source external to the reactions needs to be applied to donate or accept electrons to/from the reactions. Hence, the term "net zero external current" refers to this condition.

Figure 19:
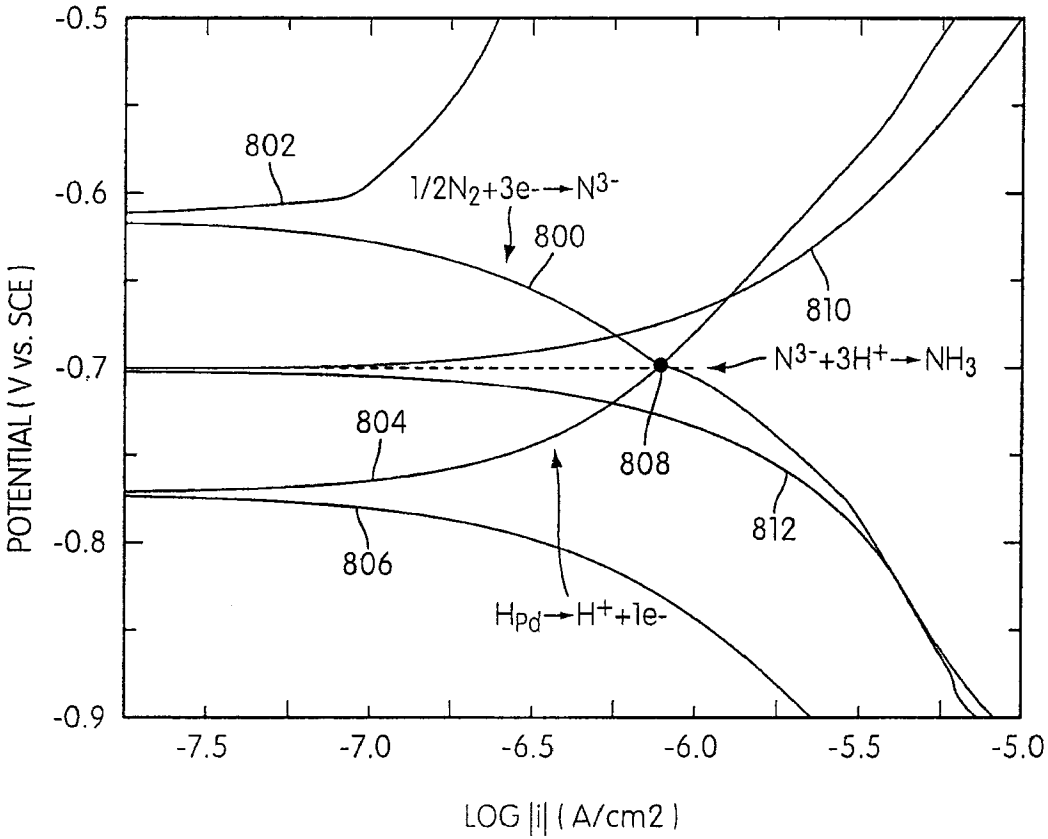
FIG. 19 is a graph showing the intersection of hydrogen oxidation and nitrogen reduction in certain embodiments

FIG. 19 illustrates the electrochemical behavior of the hydrogen oxidation and the nitrogen reduction in this embodiment of the invention in terms of potential versus the log of the absolute value of the current density. In FIG. 19, the reversible potential for $\frac{1}{2}N_2+3e^- \leftrightarrows N^{3-}$ is shown as occurring at about −0.61V (as measured between the working electrode 516 and the reference electrode 522 in the nitrogen containing electrolyte 514), with the oxidation behavior for $N^{3-}+3e^- \rightarrow \frac{1}{2}N_2$ being shown at curve 802, and the reduction behavior for $\frac{1}{2}N_2+3e^- \rightarrow N^{3-}$ being shown at curve 800. And the reversible potential for $H_{Pd} \leftrightarrows H^+ + 1e^-$ is shown as occurring at about −0.77V (which is cathodic of the reversible potential for nitrogen reduction-oxidation). The oxidation behavior for $H_{Pd} \rightarrow H^+ + 1e^-$ is shown at curve 804 and the reduction behavior for $H^+ + 1e^- \rightarrow H_{Pd}$ is shown at curve 806. The curves 800, 802, 804, and 806 are plotted against the log of the absolute value of the current density, and thus are approaching zero towards the left. As can be seen, in the window between the reversible potential for nitrogen reduction-oxidation and the reversible potential for hydrogen reduction-oxidation, the oxidation of hydrogen and reduction of nitrogen are occurring simultaneously.

In this window, curve 810 illustrates the current density representing excess electrons generated by the simultaneous hydrogen oxidation and nitrogen reduction reactions, and curve 812 illustrates the current density representing additional electrons consumed by the simultaneous hydrogen oxidation and nitrogen reduction reactions. At the point marked 808 where the curves 810 and 812 meet asymptotically, meaning that the external current density for the two reactions is zero, and thus the reactions are in balance (i.e., at the net zero external current condition, as no externally provided electrons are accepted by or donated to the two reactions). In the illustrated graph, this is occurring at −0.7V. The values in this graph should not be regarded as limiting and are shown for illustrative purposes, and may vary depending on various factors.

Balancing the reaction to net zero external current may be achieved in various ways, including increasing/decreasing the hydrogen concentration in the electrode 516 and/or the proton activity in the electrolyte 514. Likewise, a current may be applied to the electrode 516 accept/donate electrons to/from the electrode 516. Preferably, the hydrogen concentration is the parameter controlled, as that is the most power efficient manner of doing so. This is because the hydrogen needs to be created anyway, so the consumption of electrical work for that purpose is already required. In contrast, the application of current to the electrode 516 requires electrical work above and beyond that required to drive the reaction and further reducing the proton activity in the electrolyte also requires work (in some form) in addition to that required to drive the reaction. Of course, any of these techniques, or other techniques, may be used, and the invention is not limited.

Once the $N^{3-}$ and $H^+$ are in the presence of each other, they will react to produce ammonia ($NH_3$), which may bubble through the non-aqueous electrolyte 514 and travel out of the housing 502 and into an ammonia collection chamber 532. If nitrogen travels into the ammonia collection chamber 532 with the ammonia, other known means to separate the ammonia from the nitrogen may be used. For example, if the effluent of nitrogen and ammonia is pressurized to a suitable level, the ammonia will turn from gas to a liquid, which may be collected. Thermal means may also be used to transform the ammonia to a liquid.

In an experimental embodiment, potentiostatic holds at or near the zero current condition in nitrogen saturated 0.05M $KPF_6$ in DMSO using a palladium-hydride membrane have resulted in the synthesis of ammonia. Currents applied to the non-aqueous electrolyte 514 ranging between −20 μA/cm$^2$ to +5 μA/cm$^2$ over a course of approximately five hours, have yielded ammonia concentrations ranging from 160 μM to 0.5 μM ammonia in 50 ml of DMSO solution at an initial reversible potential of the working electrode 516 as −790 mV versus SCE. This was done at standard conditions (room temperature, 1 atmosphere). The current efficiency in the first chamber 504 may be about one, because most, if not all of the hydrogen that is produced within the first chamber 504 may be produced at the surface 526 of the working electrode 516 and may be consumed by the working electrode 516 rather than be converted to $H_2$ gas.

In an embodiment, the apparatus 500 may be operated at a temperature in a range of 15° Celsius and 200° Celsius. Preferably, the temperature is room temperature. In an embodiment the apparatus 500 is operated at a pressure in a range of 0.1 atmospheres to 150 atmospheres. Preferably, the pressure is between 0.5 and 5 atmospheres, and most preferably it is at atmospheric pressure.

Figure 17:
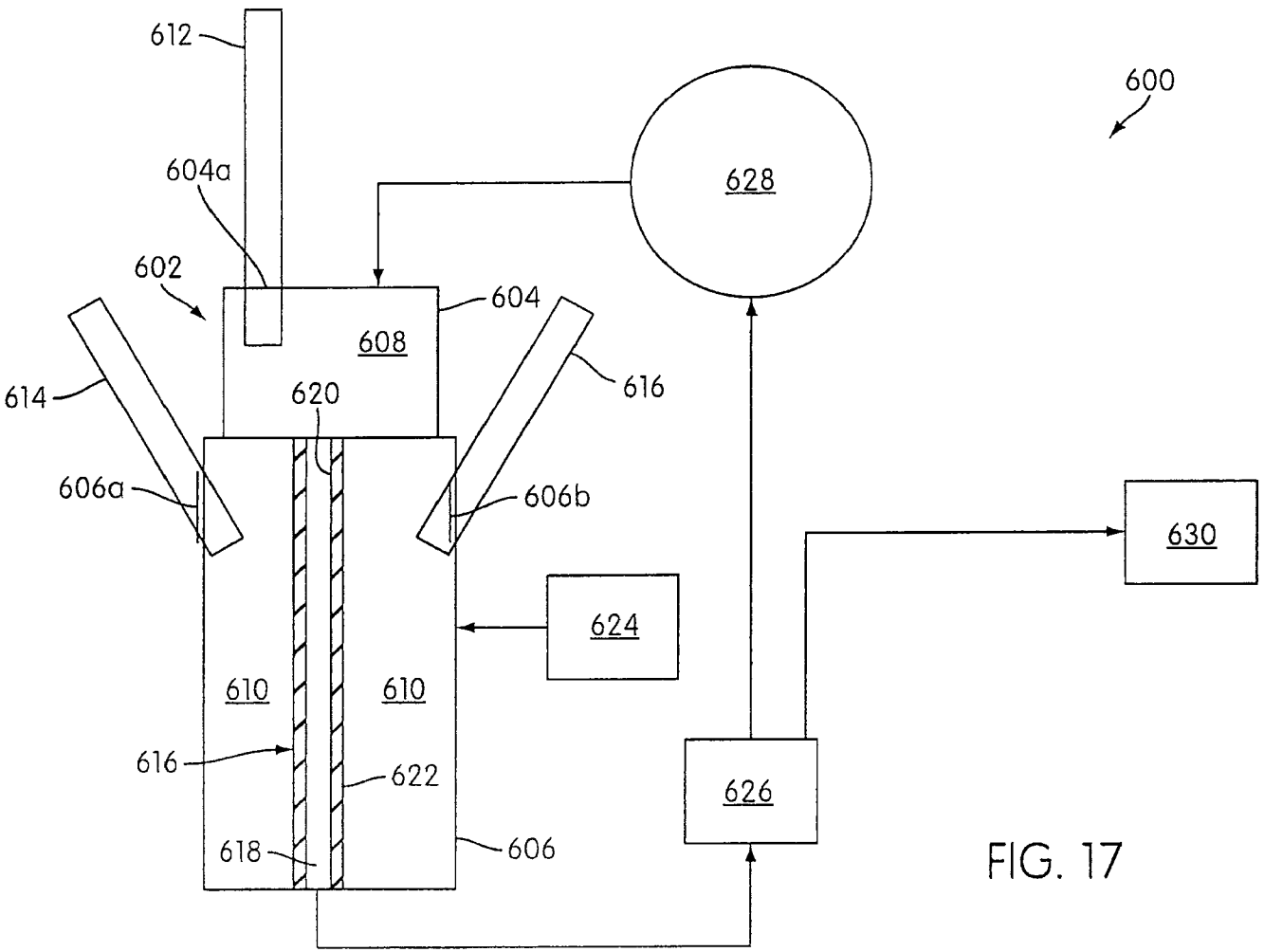
FIG. 17 is a schematic view of another embodiment of an apparatus for generating ammonia.

An apparatus 600 according to another embodiment of the present invention is illustrated in FIG. 17. As shown in FIG. 17, the apparatus 600 includes a housing 602 that includes a plurality of chambers, including a first chamber 604 and a second chamber 606. The housing 602 is preferably generally cylindrical in shape, but any other shapes may be used in accordance with the present invention. The illustrated embodiment is not intended to be limiting in any way. This embodiment operates on many of the same principles as the prior embodiment, and a full explanation of those principles need not be repeated.

The first chamber 604 is constructed and arranged to hold nitrogen. More specifically, the first chamber 604 is constructed and arranged to hold a nitrogen-containing, non-aqueous electrolyte 608 that includes nitrogen, such as those mentioned above.

The second chamber 606 is constructed and arranged to hold hydrogen. More specifically, the second chamber 606 is constructed and arranged to hold a hydrogen-containing electrolyte 610 that includes hydrogen, as discussed above in the previous embodiment.

The first chamber 604 includes a first reference electrode 612. The first reference electrode 612 may be exposed to the first chamber 604 of the housing. The first reference electrode 612 may be inserted into the first chamber 604 through a port 604*a* (shown in FIG. 17) so it is in contact with the non-aqueous electrolyte 604. In the embodiment, the first reference electrode 612 extends into the non-aqueous electrolyte 608.

The second chamber 606 includes a second reference electrode 614 and a counter electrode 616. The second reference electrode 614 and the counter electrode 616 may be exposed to the second chamber 606 of the housing 602. The second reference electrode 614 and the counter electrode 616 may be inserted into the second chamber 606 through ports 606*a*, 606*b* (shown in FIG. 17) so they are in contact with the hydrogen-containing electrolyte 610. In the embodiment, the second reference electrode 614 and the counter electrode 616 extend into the hydrogen-containing electrolyte 610.

As illustrated in FIG. 17, the apparatus 600 also includes a separator 616. The separator 616 may comprise a material that is efficient in storing atomic hydrogen (H), and may also be referred to as a working electrode 618. In an embodiment, the working electrode 618 comprises palladium (Pd). In a further embodiment, the working electrode 618 consists essentially of palladium, or other suitable materials may be used, such as those mentioned above. The working electrode 618 may take many forms. In the illustrated embodiment, the working electrode 618 is in the form of a tubular member. The tubular member may have any cross-sectional configuration, but is preferably cylindrical. The illustrated embodiment is not intended to be limiting in any way. As illustrated schematically, chamber 604 is fluidly connected to the interior of the working electrode 618, thus enabling the electrolyte 608 to flow through the interior of electrode 618. Thus, the chambers 604 and 696 are isolated from one another by the electrode 618.

As discussed above, the reversible potential for hydrogen oxidation in the working electrode 618 may be proportional to the concentration of hydrogen within the working electrode 618 and the proton activity in the non-aqueous electrolyte 608 at an inner surface 620 of the working electrode 618. By controlling the concentration of interstitial hydrogen within the working electrode 618 and decreasing the hydrogen activity in the non-aqueous electrolyte 608 at the inner surface 620, the reversible potential for hydrogen oxidation at surface 620 can be driven far negative (i.e., cathodic) of the standard hydrogen reduction-oxidation potential for $H_2 \leftrightarrows 2H^+ + 2e^-$, as well as the reduction-oxidation potential for $3N_2 + 6e^- \leftrightarrows 2N^{3-}$.

The first reference electrode 612 may be an SCE, which allows the potential that is created within the first chamber 604 across the first reference electrode 612 and the inner surface 620 of the working electrode 618 to be measured relative to the SCE. The second reference electrode 614 may also be an SCE, which allows the potential that is created within the second chamber 606 when a current is applied to the counter electrode 616 to be measured relative to the SCE. Each of the reference electrodes are coupled to the working electrode 618 with a measuring device therebetween for purposes of measuring the potential between the working electrode 618 and the respective reference electrode 612, 614.

Underpotential deposition ("UPD") may be used, as discussed above, to extract H from the hydrogen-containing electrolyte 610 and form a monolayer of H on an outer surface 622 of the working electrode 618. The H may then be rapidly absorbed by the working electrode 618, thereby allowing for another layer of H to replenish the outer surface 622 of the working electrode 618 as H travels into the working electrode 618 from the hydrogen-containing electrolyte 610. Current may be applied to the counter electrode 616 to create a potential that allows for UPD to take place on the outer surface of the working electrode 618.

In an embodiment, electrolysis or hydrolysis may be used to dissociate the hydrogen from the hydrogen-containing electrolyte 610, and allow the hydrogen to be absorbed by the working electrode 618. In an embodiment, hydrogen may be provided to the second chamber 606 by a hydrogen source 624 and absorbed by the working electrode 618. The above-described embodiments should not be considered to be limiting in any way. For example, atomic hydrogen may be provided to the working electrode 618 by other means.

Once the potential at the working electrode in the non-aqueous electrolyte 608 is above (i.e., anodic) the potential of hydrogen oxidation, protons are released into 608 as it passes the inner surface 620 of the working electrode 618, and the proton activity increases. By using a working electrode 618 with sufficient hydrogen concentration as the cathode for nitrogen reduction, $N_2 + 6e^- \leftrightarrows 2N^{3-}$, oxidized hydrogen can be provided at the same inner surface 620 while reducing the nitrogen in the same manner as discussed above with respect to the previous embodiment. By carefully regulating the potential at which the working electrode 618 may be held, a net zero current condition can be reached where three protons are released from the working electrode 618 for every nitrogen reduced, thereby forming ammonia at the inner surface 620 of the working electrode.

In an embodiment, a gas source 626 in the electrolyte circulation path may transfer the nitrogen into the non-aqueous electrolyte 608, similarly to the previous embodiment.

The rate of gas sparged into the electrolyte can be controlled to ensure an adequate amount of nitrogen for consumption by the overall ammonia generation reaction. In an embodiment, a pump 628 moves the electrolyte through the circulation path, including from chamber 604, through electrode 618, to the nitrogen source 626, and back via the pump 628 to chamber 604. This configuration allows for a continuous process in which nitrogen is supplied to the first chamber 604 and ammonia is removed from the inner surface 620 of the working electrode 618.

In an embodiment, the proton activity in the non-aqueous electrolyte 608 at the inner surface 620 of the working electrode 618 may be reduced by applying a cathodic potential to the working electrode 618, or by adding proton complexing agents to the non-aqueous electrolyte 618. In an embodiment, the effective proton activity may be reduced prior to exposing the non-aqueous electrolyte 608 to the inner surface 620 of the working electrode 618. Likewise, the hydrogen concentration may be increased by increasing the absorbed hydrogen in the electrode 618 as discussed with respect to the prior embodiments.

In an embodiment, the apparatus 600 is operated at a temperature in a range of 15° Celsius and 200° Celsius. Preferably, the temperature is room temperature. In an embodiment the apparatus 600 is operated at a pressure in a range of 0.1 atmospheres to 150 atmospheres. Preferably, the pressure is atmospheric pressure.

Once the $N^{3-}$ and $H^+$ are in the presence of each other, they will react to produce ammonia ($NH_3$), which may travel from inside the working electrode 618, out of the housing 602, and into the nitrogen source 626. The sparging of nitrogen into the electrolyte 608 at source 686 will also bubble out the ammonia. Any method or device to separate the ammonia from the nitrogen may be used. For example, if the effluent of nitrogen and ammonia is pressurized to a suitable level, the ammonia will turn from gas to a liquid, which may be collected in an ammonia collection chamber 630. Thermal means may also be used to transform the ammonia to a liquid. The collection of ammonia from the effluent may be performed in any suitable manner.

Figure 18:
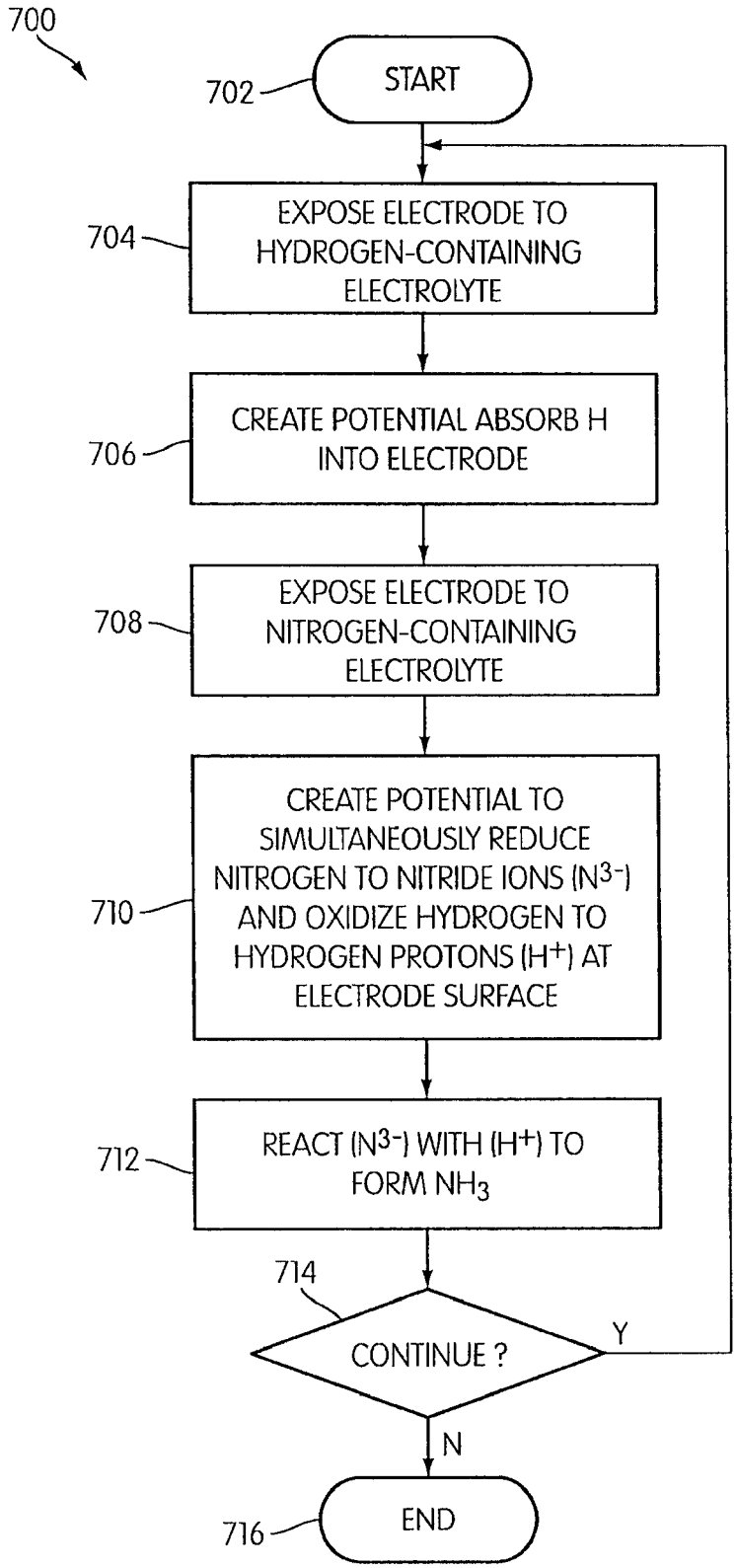
FIG. 18 is a flow chart of a method of generating ammonia in accordance with another embodiment of the present invention.

A method 700 of producing ammonia in accordance with another embodiment of the present invention is illustrated in FIG. 18. The method 700 starts at 702. At 704, an electrode, such as any of the electrodes 516 and 618 described above, although not limited to such electrodes, may be exposed to a hydrogen-containing electrolyte. At 706, a potential is created within an electrochemical cell that includes the electrode while the electrode is being exposed to the hydrogen-containing electrolyte so that atomic or ionic hydrogen may be absorbed by the electrode, such as in the manner described above. The hydrogen-containing electrolyte may include, but is not limited to any of the hydrogen-containing electrolytes described above.

After the hydrogen has been absorbed by the electrode, the electrode may be exposed to a nitrogen-containing electrolyte at 708. The nitrogen-containing electrolyte may include, but is not limited to the any of the nitrogen-containing electrolytes described above. While the electrode is being exposed to the nitrogen-containing electrolyte, a potential may be created in the electrochemical cell that is suitable to reduce the nitrogen in the nitrogen-containing electrolyte to nitride ions at 710. Simultaneously, at 710, another potential more anodic than the first potential is applied to the electrode, thereby reducing the proton activity of the nitrogen-containing electrolyte, so that hydrogen absorbed into the electrode is oxidized to hydrogen protons, $H^+$, at the same surface of the electrode that the nitrogen is reduced to nitride ions.

Once the nitrogen has been reduced to nitride ions, and the hydrogen has been oxidized, the nitride ions may react with the oxidized hydrogen at the surface of the electrode to form ammonia at 712. At 714, a decision is made whether to continue the method 700. If the method 700 is to be continued, the method returns to 704 and the electrode is exposed to the hydrogen-containing electrolyte once again. If the method is to be discontinued, the method ends at 716.

Embodiments of the present invention contemplate any configuration in which the electrode is exposed to a hydrogen-containing electrolyte and a nitrogen-containing electrolyte, and suitable potentials are applied to the electrode as the electrode is exposed to the different electrolytes. The above-described embodiments are not intended to be limiting in any way.

An advantage of the embodiments where the reduction-oxidation potential for $H_2 \leftrightarrows 2H^+ + 2e^-$ is shifted cathodic of the reduction-oxidation potential for $3N_2 + 6e^- \leftrightarrows 2N^{3-}$ is that the oxidation of hydrogen and reduction of nitrogen can take place simultaneously and the reactions self charge balance one another. One way of keeping this balance is to monitor the potential between the working electrode 516/618 and the reference electrode 522/612. If a variance from net zero external current is detected (which may be indicated in a voltage difference between the electrodes), or a variance outside a range from net zero external current (such as +/−100 microamperes/$cm^2$) is detected, a controller can adjust the electrical signal between the counter electrode 520/616 and working electrode 516/618 to increase/decrease the absorption of hydrogen into working electrode 516/618. Thus, by using the potential in the nitrogen containing cell to adjust the potential in the hydrogen containing cell, the process can be kept balanced solely through adjustment of the hydrogen absorption process. Any suitable controller for such monitoring and controlling may be used, such as a programmable microprocessor based controller, or a controller with a chipset dedicated to this purpose.

As another optional feature, instead of using bulk non-aqueous electrolyte in the embodiments 500 and 600 and sparging nitrogen gas to maintain the concentration in the electrolyte at a suitable level, the chambers 506, 604 can contain the nitrogen in gaseous form and a nozzle or other device can spray the non-aqueous electrolyte onto the surface 524, 620 of the working electrode 516, 618. The non-aqueous electrolyte can be misted, atomized, or otherwise formed on and exposed to that electrode surface in any suitable manner to form a thin film of electrolyte. This optional approach is believed to be beneficial, as the nitrogen gas in the chamber can diffuse easily into the layer of electrolyte on the electrode surface, whereby the nitrogen reduction and reaction with oxidized hydrogen to form ammonia can take place. With a bulk liquid electrolyte saturated with nitrogen by sparging or other means, the rate of diffusion of the nitrogen through the electrolyte may limit the efficiency and rate of the reactions. And with a film layer on the electrode in the presence of nitrogen gas, it is believed that diffusivity will be less of a constraint in this regard, as diffusion via the film layer should occur at a faster rate (particularly given the high surface area at the nitrogen-electrolyte film layer interface relative to the thickness of the film layer). Thus, exposure of the electrode to a nitrogen-containing electrolyte need not require immersion or contact with a bulk liquid supply of electrolyte, and can also occur by allowing the nitrogen to become contained in a film layer of the electrolyte by this type of diffusion, or any other suitable way of providing an electrolyte with nitrogen therein to the appropriate electrode surface.

The foregoing detailed description has been provided solely for purposes of illustrating the structural and functional principles of the present invention and is in no way intended to be limiting. To the contrary, the present invention is intended to encompass all variations, modifications, substitutions, alterations and equivalents within the spirit and scope of the appended claims.

What is claimed is:

1. A method for making ammonia ($NH_3$), comprising:

exposing a first surface of a hydrogen receptive working electrode to a hydrogen containing electrolyte and a second surface of the electrode to a non-aqueous nitrogen-containing electrolyte, the electrolytes being separated from one another by the working electrode;

applying current between the working electrode and a counter electrode exposed to the hydrogen containing electrolyte so as to cause absorption of hydrogen into the working electrode via the first surface;

wherein the hydrogen is absorbed into the working electrode at a concentration such that the working electrode at the second surface thereof simultaneously oxidizes the absorbed hydrogen to form hydrogen protons ($H^+$) and reduces the nitrogen to form nitride ions ($N^{3-}$); and reacting the $H^+$ and $N^{3-}$ to form $NH_3$.

2. A method according to claim 1, further comprising adjusting the current between the working electrode and the counter electrode exposed to the hydrogen containing electrolyte to control the concentration of absorbed hydrogen in the electrode.

3. A method according to claim 2, wherein a potential is measured between the working electrode and a reference electrode exposed to the nitrogen containing electrolyte, and wherein a controller adjusts the current between the working electrode and the counter electrode exposed to the hydrogen containing electrolyte based on the measured potential to adjust the concentration of hydrogen absorbed in the working electrode.

4. A method according to claim 3, wherein the controller adjusts the current between the working electrode and the counter electrode exposed to the hydrogen containing electrolyte based on the measured potential so that the oxidation to $H^+$ and the reduction to $N^{3-}$ occur at a substantially net zero external current.

5. A method according to claim 4, wherein the controller adjusts the current between the working electrode and the counter electrode exposed to the hydrogen containing electrolyte based on the measured potential so that the oxidation to $H^+$ and the reduction to $N^{3-}$ occur at net zero external current.

6. A method according to claim 4, wherein the controller adjusts the current between the working electrode and the counter electrode exposed to the hydrogen containing electrolyte based on the measured potential so that the oxidation to $H^+$ and the reduction to $N^{3-}$ occur within +/−100 microamperes/$cm^2$ of net zero external current.

7. A method according to claim 1, wherein the current applied between the working electrode and the counter electrode exposed to the hydrogen containing electrolyte causes the absorption of hydrogen into the working electrode via the first surface by underpotential deposition.

* * * * *